US011034478B1

(12) United States Patent
Lau et al.

(10) Patent No.: US 11,034,478 B1
(45) Date of Patent: Jun. 15, 2021

(54) DOUBLE-WALLED CONTAINER WITH DUAL OPENINGS

(71) Applicants: Lawrence Michael Lau, San Francisco, CA (US); Charlene Lyu, Campbell, CA (US); Alexander Christopher Lau, Newtown, PA (US)

(72) Inventors: Lawrence Michael Lau, San Francisco, CA (US); Charlene Lyu, Campbell, CA (US); Alexander Christopher Lau, Newtown, PA (US)

( * ) Notice: Subject to any disclaimer, the term of this patent is extended or adjusted under 35 U.S.C. 154(b) by 358 days.

(21) Appl. No.: 16/209,802

(22) Filed: Dec. 4, 2018

Related U.S. Application Data

(63) Continuation-in-part of application No. 15/961,658, filed on Apr. 24, 2018, now Pat. No. 10,683,128, which is a continuation of application No. 14/931,484, filed on Nov. 3, 2015, now Pat. No. 9,950,827.

(60) Provisional application No. 62/594,410, filed on Dec. 4, 2017, provisional application No. 62/074,286, filed on Nov. 3, 2014, provisional application No. 62/162,669, filed on May 16, 2015, provisional application No. 62/194,749, filed on Jul. 20, 2015.

(51) Int. Cl.

| | |
|---|---|
| ***B65D 51/16*** | (2006.01) |
| ***B65D 1/02*** | (2006.01) |
| ***B65D 1/04*** | (2006.01) |
| ***B65D 23/00*** | (2006.01) |
| ***B65D 23/02*** | (2006.01) |
| ***A45F 3/16*** | (2006.01) |

(52) U.S. Cl.
CPC ..... *B65D 1/04* (2013.01); *A45F 3/16* (2013.01); *B65D 1/0246* (2013.01); *B65D 23/001* (2013.01); *B65D 23/02* (2013.01); *B65D 51/1644* (2013.01); *A45F 2003/166* (2013.01)

(58) Field of Classification Search
CPC ..... B65D 51/1644; B65D 81/3841; B65D 81/3876; B65D 1/04; B65D 1/0246; B65D 23/001; B65D 23/02; A45F 2003/166; A45F 3/16; A47J 41/02
USPC ..... 206/217
See application file for complete search history.

(56) References Cited

U.S. PATENT DOCUMENTS

2018/0353011 A1* 12/2018 Pinelli ..... C25D 7/04

* cited by examiner

*Primary Examiner* — Anthony D Stashick
*Assistant Examiner* — Lauren Kmet

(57) ABSTRACT

A double-walled container includes a top opening, and a bottom opening, opposite the top opening. A removable top cap engages with threads at the top opening and a removable bottom cap engages with threads at the bottom opening. The double-walled container includes an outer wall and an inner wall. A channel formed on and encircling the outer wall includes a vacuum port through which air between the outer and inner walls is drawn out to form an insulating space between the inner and outer walls. A band is positioned within the channel to cover the vacuum port.

20 Claims, 23 Drawing Sheets

DOUBLE-WALLED CONTAINER WITH DUAL OPENINGS

CROSS-REFERENCE TO RELATED APPLICATIONS

This patent application claims priority to U.S. provisional patent application 62/594,410, filed Dec. 4, 2017, and is a continuation-in-part of U.S. patent application Ser. No. 15/961,658, filed Apr. 24, 2018, which is a continuation of U.S. patent application Ser. No. 14/931,484, filed Nov. 3, 2015, issued as U.S. Pat. No. 9,950,827 on Apr. 24, 2018, which claims priority to U.S. provisional patent applications 62/074,286, filed Nov. 3, 2014, 62/162,669, filed May 16, 2015, and 62/194,749, filed Jul. 20, 2015; all of which are incorporated by reference herein for all purposes.

BACKGROUND OF THE INVENTION

The present invention relates to containers, and more specifically, to an insulated double wall container design with dual openings.

Conventional containers including reusable water or hydration bottles, food storage containers, item storage containers, and so forth do not provide the user with flexibility to reconfigure. User must often purchase many different types of containers depending on what they wish to store. Conventional containers may include insulated containers and non-insulated containers. Conventional containers are generally of a fixed volume and do not readily adapt to the user's changing storage needs. Conventional containers can also be very difficult to clean. For example, depending upon the depth of the container, opening size of the container, or both, it may be very difficult to insert one's hand through the opening to clean the bottom of the container.

There is a need for a new type of insulated container design that is modular such that parts of the container can be easily reused and assembled to provide the user with different container configurations.

BRIEF SUMMARY OF THE INVENTION

In a specific embodiment, a double-walled container includes a top opening, and a bottom opening, opposite the top opening. A removable top cap engages with threads at the top opening and a removable bottom cap engages with threads at the bottom opening. The double-walled container includes an outer wall and an inner wall. A channel formed on and encircling the outer wall includes a vacuum port through which air between the outer and inner walls is drawn out to form an insulating space between the inner and outer walls. A band is positioned within the channel to cover the vacuum port.

In a specific embodiment, there is a double-walled container comprising: a top opening; a bottom opening, opposite the top opening; a removable top cap that engages with threads at the top opening to seal the top opening; a removable bottom cap that engages with threads at the bottom opening to seal the bottom opening; an outer wall; an inner wall, the inner and outer walls having top edges joined to form the top opening, and bottom edges joined to form the bottom opening; a space between the outer and inner walls; a channel encircling the outer wall, between the top and bottom openings, and extending into the space; a vacuum port at a bottom of the channel to draw air out of the space and create a vacuum in the space; and a band positioned in the channel and covering the vacuum port.

A depth of the channel may be less than a distance between the outer and inner walls. The removable top and bottom caps may be identical to each other. A size of the top opening may be equal to a size of the bottom opening. In an embodiment, the channel is closer to one of the top or bottom openings than another of the top or bottom openings. A distance between the channel and the bottom opening may be equal to a distance between the channel and the top opening.

In an embodiment, an outside surface of the band is flush with an outside surface of the outer wall. The band may include silicone. In an embodiment, outside surfaces of the removable top cap, removable bottom cap, outer wall, and band are flush with each other. A width of the band may be greater than a distance between a bottom edge of the band and a top edge of the bottom cap.

In another specific embodiment, there is a double-walled container comprising: a top opening; a bottom opening, opposite the top opening, and having a size equal to a size of the top opening; a removable top cap that engages with threads at the top opening to seal the top opening; a removable bottom cap that engages with threads at the bottom opening to seal the bottom opening; an outer wall; an inner wall, the inner and outer walls having top edges joined to form the top opening, and bottom edges joined to form the bottom opening; a space between the outer and inner walls; a channel, the channel being formed around the outer wall, between the top and bottom openings, and extending into the space towards the inner wall; a vacuum port in the channel to draw air out of the space and create a vacuum in the space; and a band positioned in the channel and covering the vacuum port.

A thickness of the band may be equal to a depth of the channel, thereby allowing an outer surface of the band to be flush with an outer surface of the outer wall. The removable top and bottom caps may be identical to each other. In an embodiment, a cross-sectional shape of the band comprises a rectangle, and the band is positioned in the channel such that a long side of the rectangle is visible to a user. A depth of the channel may be less than a distance between the outer and inner walls, the channel thereby not touching the inner wall.

In another specific embodiment, there is a double-walled container comprising: a first end having first threads, and a first opening extending into an interior space for storing food; a second end having second threads, and a second opening, opposite the first opening, and extending into the interior space, a diameter of the second opening being the same as a diameter of the first opening; an outer wall extending between the first and second ends; an inner wall extending between the first and second ends, the inner and outer walls being welded together at the first and second ends; a gap between the outer and inner walls; a channel formed around the outer wall, the channel being between the first threads at the first end and the second threads at the second end, extending into the gap towards the inner wall, and comprising a vacuum port at a bottom of the channel to draw air out from the gap and form an insulating vacuum space between the outer and inner walls; a band retained within the channel and covering the vacuum port, the band comprising a thickness that is equal to a depth of the channel so that an outer surface of the band is flush with an outer surface of the outer wall; a first cap removably coupled to the first threads at the first end; and a second cap removably coupled to the second threads at the second end.

In a specific embodiment, the first and second caps are interchangeable with each other, the first cap thereby being capable of being removably coupled to the second threads at the second end, and the second cap thereby being capable of being removably coupled to the first threads at the first end. A cross-sectional shape of the band may include a rectangle having a pair of long sides, and a pair of short sides, each long side being parallel to each other, and each short side being parallel to each other and perpendicular to the pair of long sides, and wherein the band is positioned in the channel such that a first long side of the band faces the bottom of the channel, and a second long side of the band, opposite the first long side, faces away from the bottom of the channel.

In an embodiment, surfaces of the first and second caps are flat to support the double-walled container sitting in a first orientation, and a second orientation, flipped 180 degrees from the first orientation. In an embodiment, a first distance is between a first point on the band and a second point on the band, diametrically opposite the first point, a second distance is between a second point on the outer wall and a third point on the outer wall, diametrically opposite the second distance, and wherein the second distance is equal to the first distance.

An insulated container includes a top opening and a bottom opening, opposite the top opening, an outer shell, and an inner shell. The inner shell is encased by the outer shell. There is a vacuum space between the inner and outer shells. A sidewall of the outer shell includes a vacuum port through which the vacuum space is created. A top cap is removably connected over the top opening. A bottom cap is removably connected over the bottom opening.

Other objects, features, and advantages of the present invention will become apparent upon consideration of the following detailed description and the accompanying drawings, in which like reference designations represent like features throughout the figures.

DETAILED DESCRIPTION OF THE INVENTION

Figure 1:
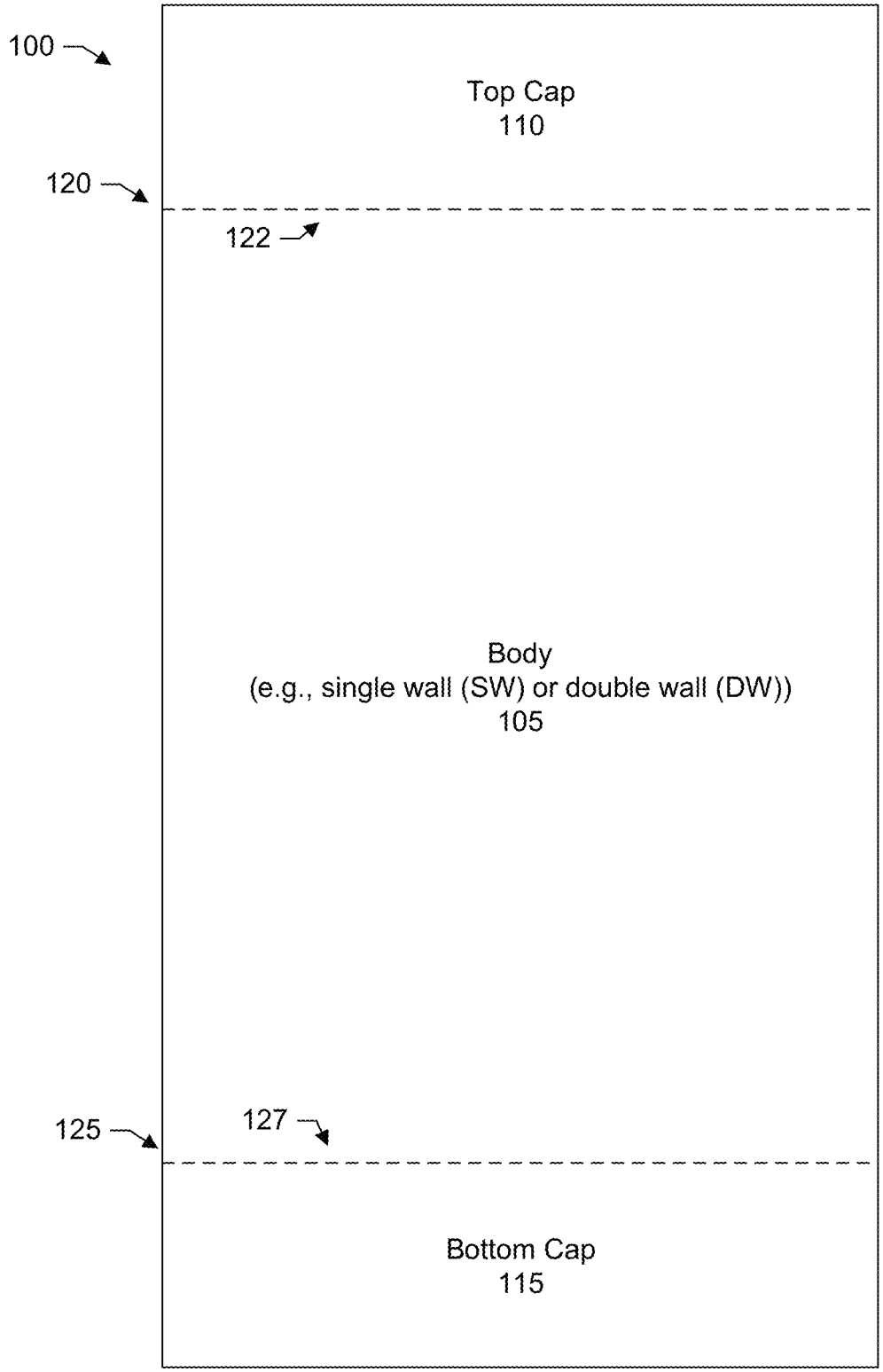
FIG. 1 shows a block diagram of a modular container.

FIG. 1 shows a block diagram of a container 100. The container includes a body 105, a top cap 110, and a bottom cap 115. The top cap is removably connected to a top end 120 of the body and covers a top opening 122 of the body. The bottom cap is removably connected to a bottom end 125 of the body, opposite the top end, and covers a bottom opening 127 of the body. In FIG. 1, the dual openings (e.g., top and bottom openings) are shown using broken lines. In various specific embodiments, the container is configured to store, contain, or hold a food product including liquid food products, semi-liquid food products, or solid food products. Specific examples of food products include water, sports drinks, coffee, tea, drink powders, purees, baby food, stews, soup, pasta, vegetables, and meats just to name a few examples.

In a specific embodiment, the body is constructed using a single wall (SW) design. In another specific embodiment, the body is constructed using a vacuum insulated double wall (DW) design. The double wall design provides insulation to help to lengthen the time over which the contents remain cooler (or hotter) than the container's surrounding environment. The double wall design can also help to reduce condensation on a hot day when the container is used to hold cold liquids. Some benefits of the single wall design is that such a design can weigh less than a double wall design and is also generally less expensive to produce than the double wall design. Depending upon factors such as desired price, weight, anticipated use, performance expectations, and others, some users may prefer a double wall construction while other users may prefer a single wall construction.

Figure 2:
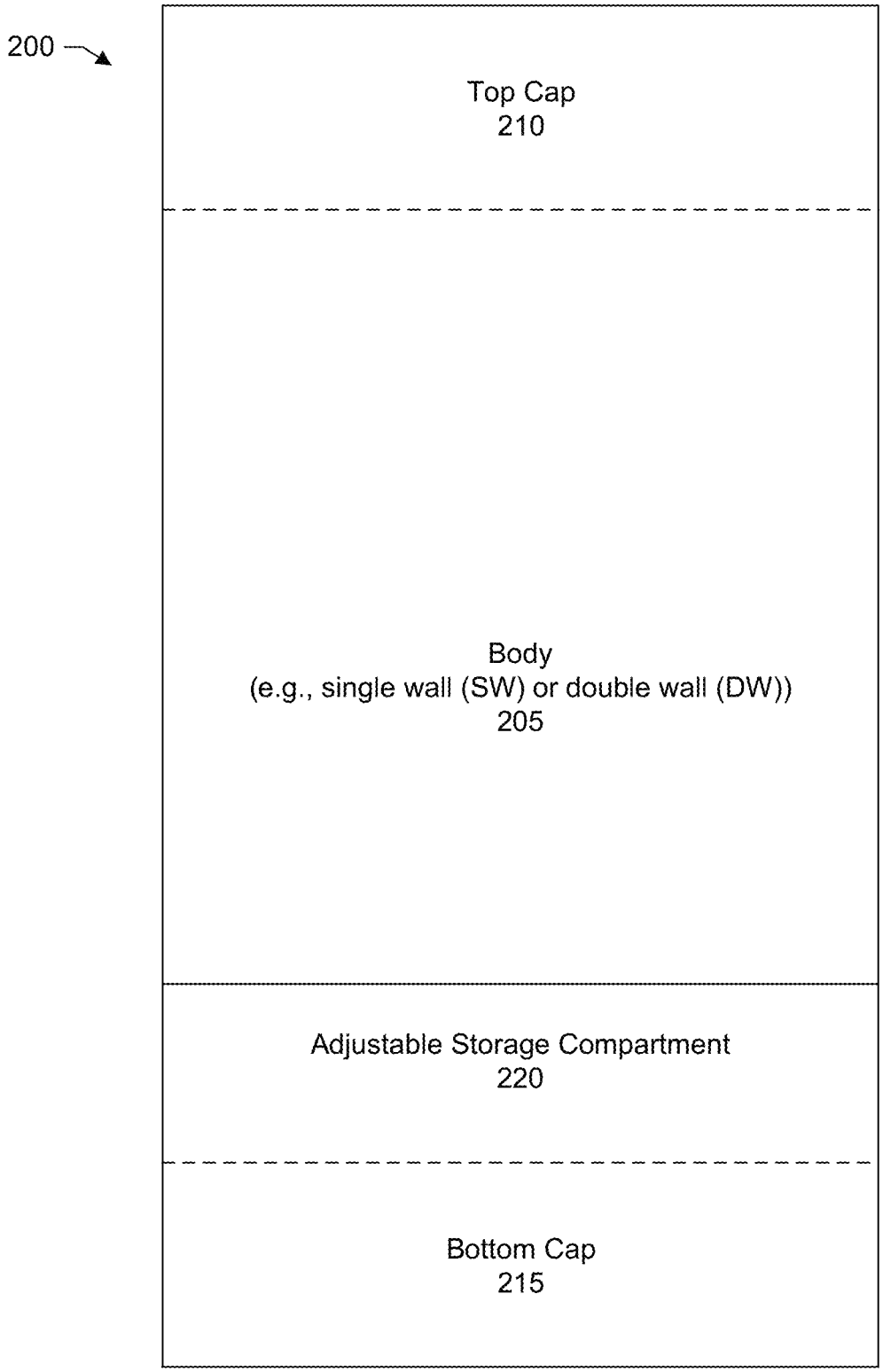
FIG. 2 shows a block diagram of a modular container having been configured with an adjustable storage compartment.

The removable bottom cap facilitates cleaning and provides for a modular design in which the container may be configured in many different ways. For example, FIG. 2 shows a block diagram in which a container 200 having a body 205, a top cap 210, and a bottom cap 215 has been configured with an adjustable storage compartment 220. A user of the container can use the storage compartment to store an item such as a key, credit card, coins, identification card, driver's license, sunscreen, energy bar, supplements, drink powders, drink mixes, vitamins, and so forth. The volume of the adjustable storage compartment can vary depending upon the size of the item placed inside the compartment.

Figure 3:
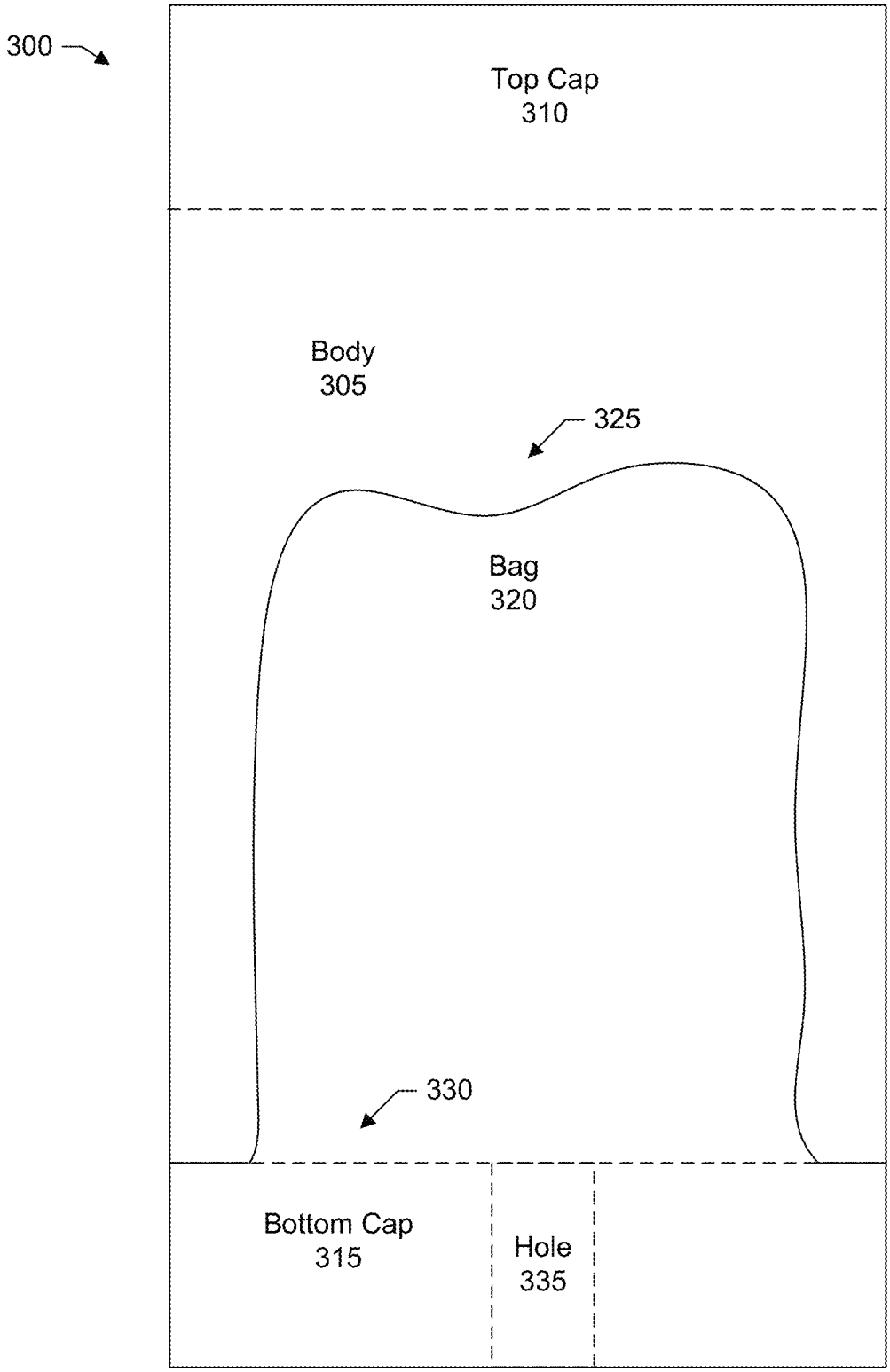
FIG. 3 shows further detail of a modular container having been configured with an adjustable storage compartment according to a specific embodiment.

In a specific embodiment, the adjustable storage compartment is implemented by a bag. More particularly, FIG. 3 shows a container 300 having a body 305, a top cap 310, a bottom cap 315, and a bag 320 positioned inside the body. The bag includes a closed end 325 (e.g., having no opening) and an open end 330 (e.g., having an opening), opposite the closed end. The closed end of the bag is closer to a top end of a body than the bottom end of the body. The open end of the bag is closer to the bottom end of the body than the top end of the body. The opening of the bag defines a bottom opening of the container. The bottom cap covers the open end of the bag or bag opening to retain any items that are placed inside the bag. The bottom cap includes at least one hole 335 in fluid communication with the inside of the bag.

The bag divides an interior space of the body into first and second interior spaces. The body and exterior or outside of the bag defines a first compartment or chamber. The first compartment may be referred to as a drink compartment. The interior or inside of the bag defines a second compartment. The second compartment may be referred to as a storage or accessory compartment.

Figure 5:
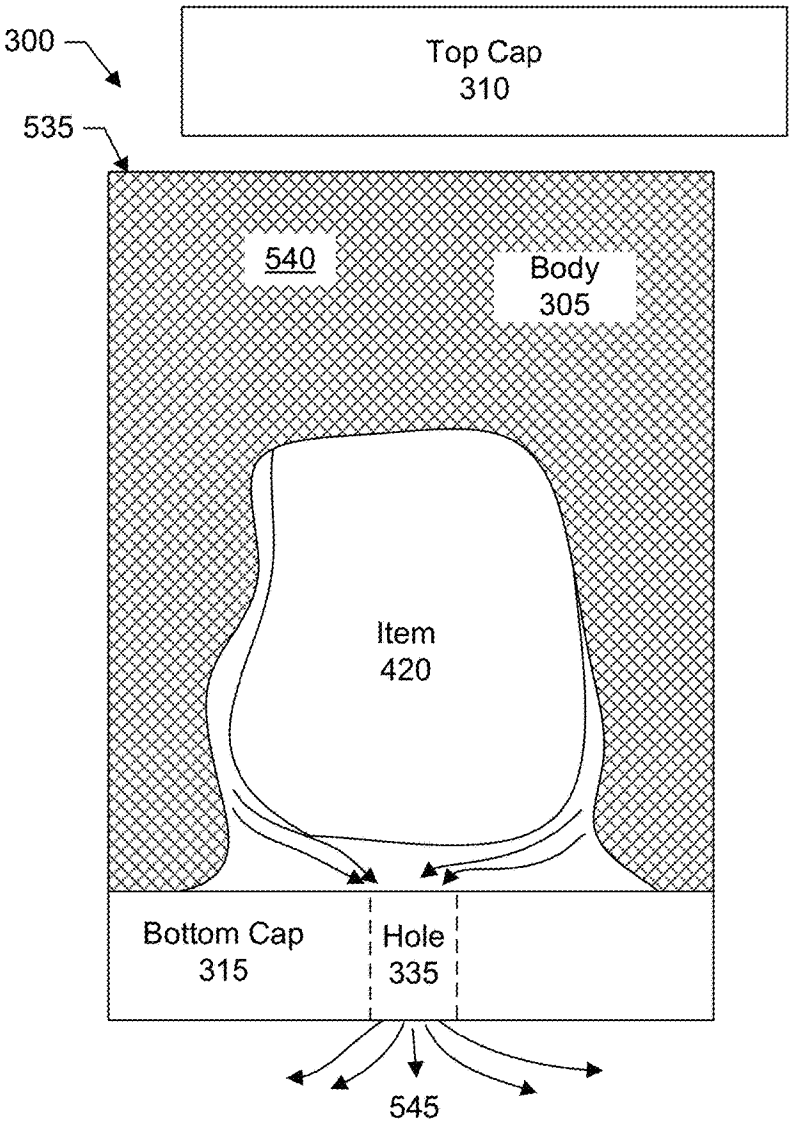
FIG. 5 shows a block diagram of the container shown in FIG. 3 in a second position with a drink having been poured into the container.
Figure 4:
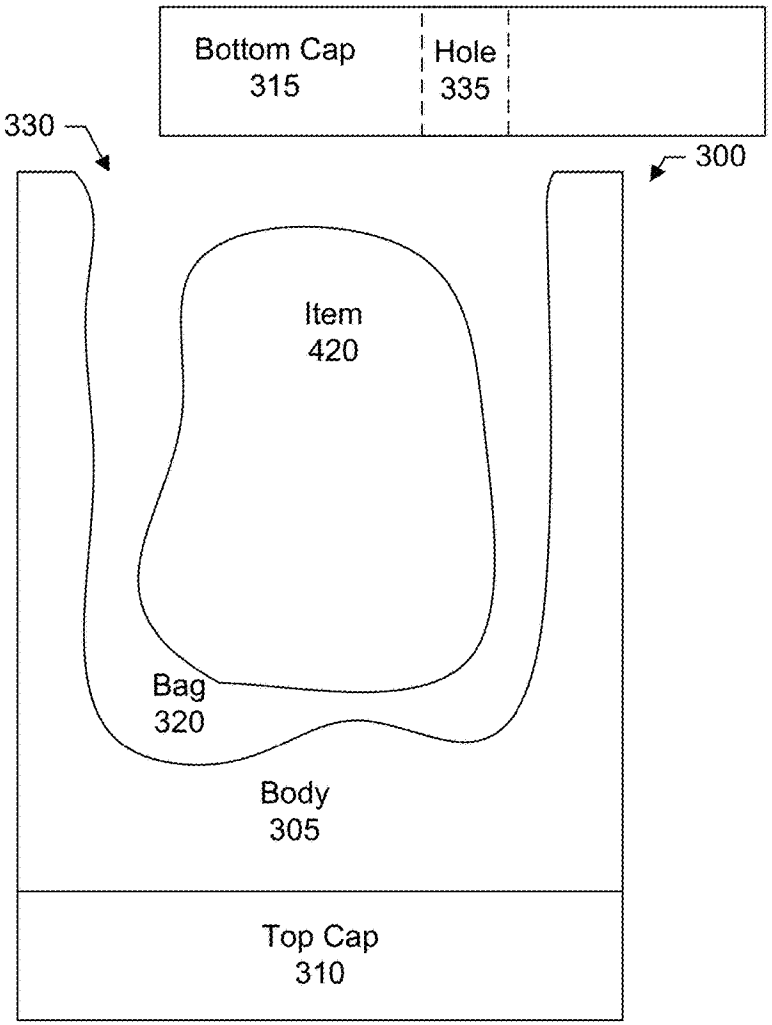
FIG. 4 shows a block diagram of the container shown in FIG. 3 in a first position with an item having been placed inside the adjustable storage compartment.

A feature of the container includes self-adjusting compartments provided by the bag. For example, FIGS. 4-5 show first and second states, respectively, of container 300. FIG. 4 shows the container in an inverted, upside down, or flipped position. In FIG. 4, the bottom cap is shown separated from the container body to indicate that is has been removed from the container body to expose bag or bottom opening 330. A user can then access the storage compartment (e.g., bag) to insert one or more items 420 through the bottom opening defined by the bag opening and into the inside of the bag. Once the item has been placed into the bag, the user can then secure the bottom cap to the bottom end of the container body to cover the bottom opening, and flip the container right-side up.

FIG. 5 shows container 300 flipped right-side up with bottom cap 315 having been placed back onto the container body. In FIG. 5, top cap 310 is shown separated from the container body to indicate that it has been removed from the container body to expose an opening 535 at the top of the container body. Opening 535 may be referred to as a top opening. The user can pour a drink 540 (e.g., water) or otherwise introduce a food product through the top opening and into the body. The pressure or weight exerted by the food product (e.g., drink) on the bag at least partially collapses or shrinks the bag around the item as air in the bag is pushed out and allowed to escape 545 through at least one hole 335 in bottom cap 315. The at least one hole passes from an inside surface of the bottom cap to an outside surface of the bottom cap. The at least one hole provides a passage or airway for fluid (e.g., air) to pass from an inside of the bag to an outside of the bag. That is, a flow path of air is from an interior space of the bag and out the at least one hole. Air may be allowed to pass freely between an inside of the bag and an outside of the bag.

The at least partial collapsing of the bag increases or redistributes the volume available in the container body (or first compartment) for the drink or other food product. The bag allows the available volume in the container for the drink or other food product to vary based on the item (e.g., based on the size of the item, number of items, or both). The pressure, fluid pressure, or weight of the drink or food product on the bag causes the bag to conform around the item placed inside the bag and to compress at least some of the unused or empty space within the bag which then results in additional space available for the drink or other food product. In other words, the space or volume within the bag becomes smaller as the space or volume within the container body for the drink or other food product becomes larger.

In a specific embodiment, the container is designed as a hydration bottle or hydration container. In this specific embodiment, a user can use the bottle while running errands, commuting, traveling, cycling, hiking, running, walking, at the gym or health club, working out, or participating in any other activity. In many cases, the user will have a need or desire to carry additional items. Such items may include keys, money, credit cards, food (e.g., energy bars, energy gels, or supplements), first aid supplies (e.g., adhesive bandages), pills (e.g., aspirin), tools, spare parts, an extra battery, and so forth. For example, if the user is at a health club, the user can use the storage compartment to store things such as a locker key, energy bar, supplements, and the like while exercising. The user will not have to keep track of multiple things such as a separate water bottle, locker key, supplements, and energy bar because these items can all be carried in a single container.

In this specific embodiment, with this container, each individual user can decide for themselves how they would like to make the trade-off between the space or volume available for the drink and the space or volume available for the item. For example, storing a large item in the bag results in less available space for a drink. Alternatively, storing a small item in the bag results in more space that is available for a drink. In some cases, a user may elect to have more space available for a drink and less space available for an item. In other cases, the user may elect to have more space available for an item and less space available for the drink. The same container can be used in both cases because the drink and storage compartments are self-adjusting. Combining functions such as drink and item storage into a single container also helps to reduce the likelihood that the user will forget to take something when preparing for the activity, lose something during the activity, or forget something when moving to a different activity. Further discussion of a container having self-adjusting drink and item storage compartments is provided in U.S. patent application Ser. No.

14/931,484, filed Nov. 3, 2015, and is incorporated by reference along with all other references cited.

Figure 6:
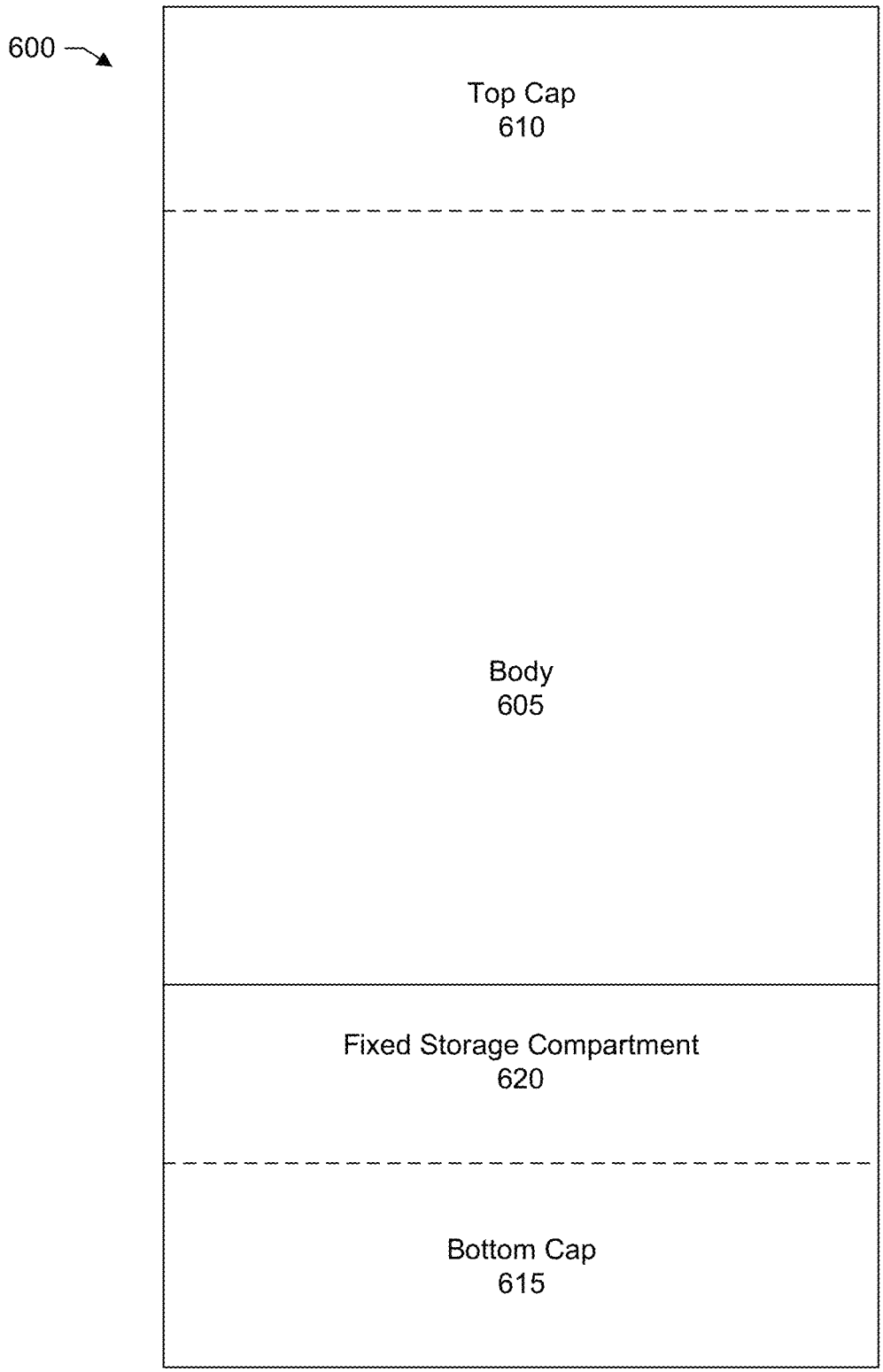
FIG. 6 shows a block diagram of a modular container having been configured with a fixed storage compartment according to a specific embodiment.

FIG. 6 shows a block diagram in which a container 600 having a body 605, a top cap 610, and a bottom cap 615 has been configured with a fixed storage compartment 620. In other words, in this specific embodiment, a volume of the storage compartment remains static and does not change. In a specific embodiment, a container is designed to be modular such that various parts of the container are interchangeable or reusable in other configurations. In a specific embodiment, the parts are designed to be interchangeable by the user. The adjustable storage compartment and fixed storage compartment may be made available for purchase as separate units.

For example, in this specific embodiment, the adjustable storage compartment may be attached to a body of a particular container having a top cap and a bottom cap. The user may reconfigure the container to have a fixed storage compartment by detaching the adjustable storage compartment from the body of that particular container and attaching instead the fixed storage compartment to the body. The same container body, top cap, and bottom cap can be used with both the adjustable storage compartment configuration and the fixed storage compartment configuration.

In a specific embodiment, a container may be provided as a kit having modular or interchangeable parts. The kit may include a container body, top cap, bottom cap, adjustable storage compartment, and fixed storage compartment. Depending upon the user's immediate needs, the user may configure the container with one of the adjustable storage compartment or fixed storage compartment. At a later time, when the user's needs change, the user may reconfigure the container with another of the adjustable storage compartment or fixed storage compartment. As another example, a container kit may include the container body, top cap, and bottom cap. The adjustable storage compartment module, fixed storage compartment module, or both may be made available as units separate from the container kit. Thus, the user can purchase the container kit and then decide, based on need, whether to purchase the adjustable storage compartment module, the fixed storage compartment module, or both.

This modular design provides the user with great flexibility in determining how to configure the container. The ability to reuse at least some parts in each of the different configurations helps to reduce the overall cost of the container and facilitates replacement of worn or damaged parts. For example, when a part of the container becomes damaged, rather than purchasing an entire new container, the user may purchase just a new corresponding part to replace the damaged part. The user can easily and cost-effectively swap between a container having an adjustable storage compartment and a container having a fixed storage compartment, or vice-versa. In another specific embodiment, a container is provided without having any separate storage compartment, but having a removable bottom cap to facilitate cleaning. Further discussion is provided below. Other examples of modular components that may be adapted to connect to an end of the container include a rechargeable battery having a charging port to charge portable electronic devices (e.g., smartphone, tablet computer), water filtration device, heating element (to keep a stored food product hot or warm), cooling element (to keep a stored food product cold or cool), infusion device, and so forth.

Figure 7:
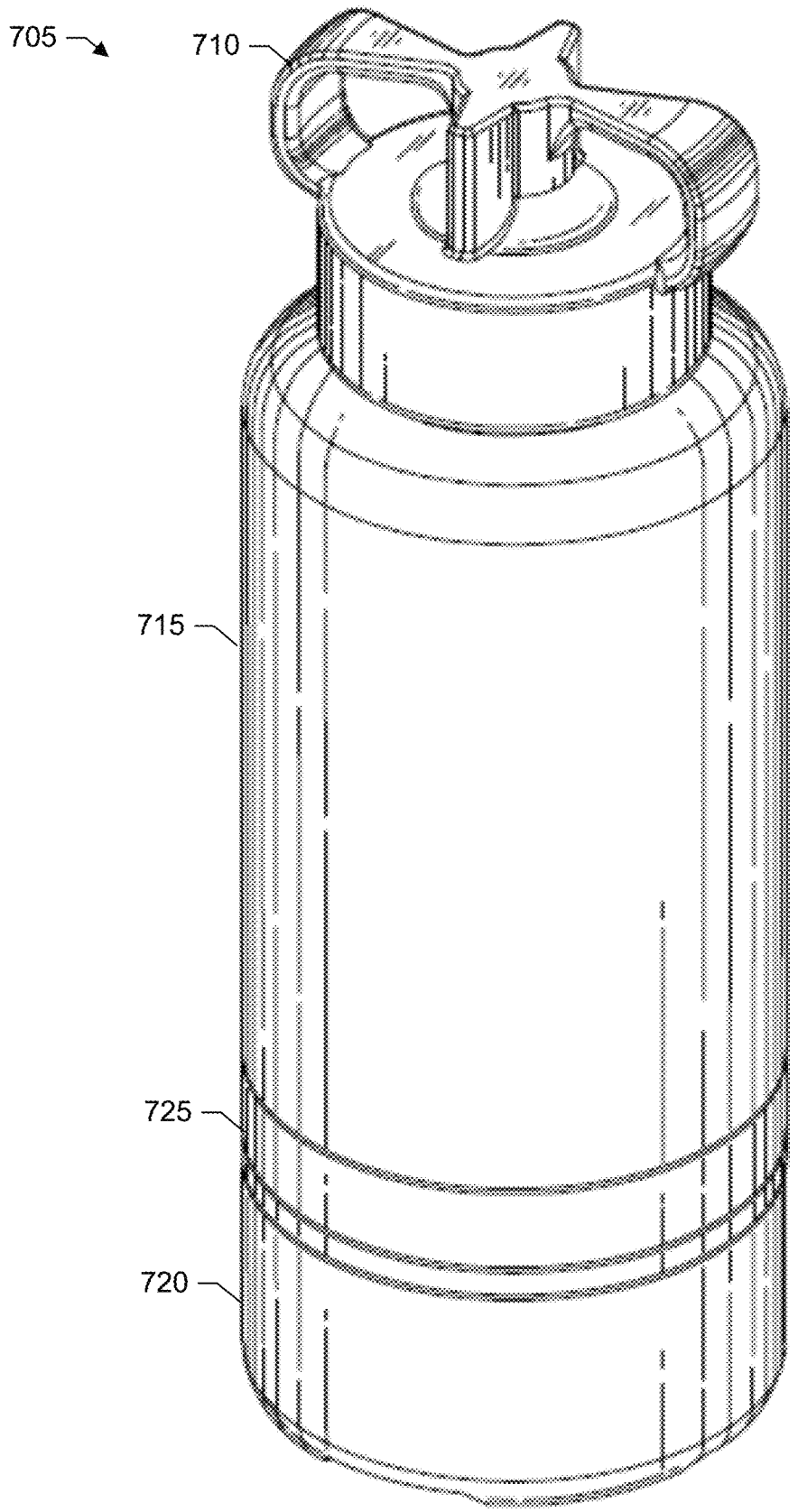
FIG. 7 shows a perspective view of a modular container according to a specific embodiment.
Figure 8:
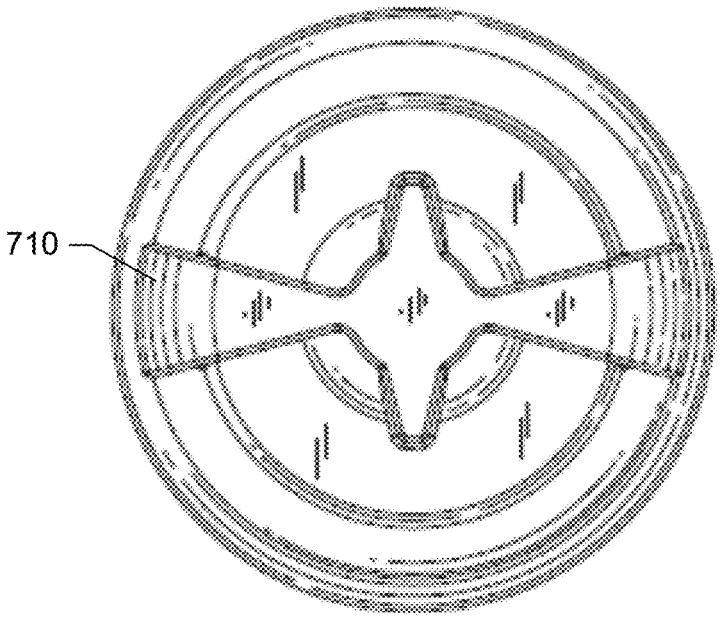
FIG. 8 shows a top view of the modular container shown in FIG. 7.
Figure 9:
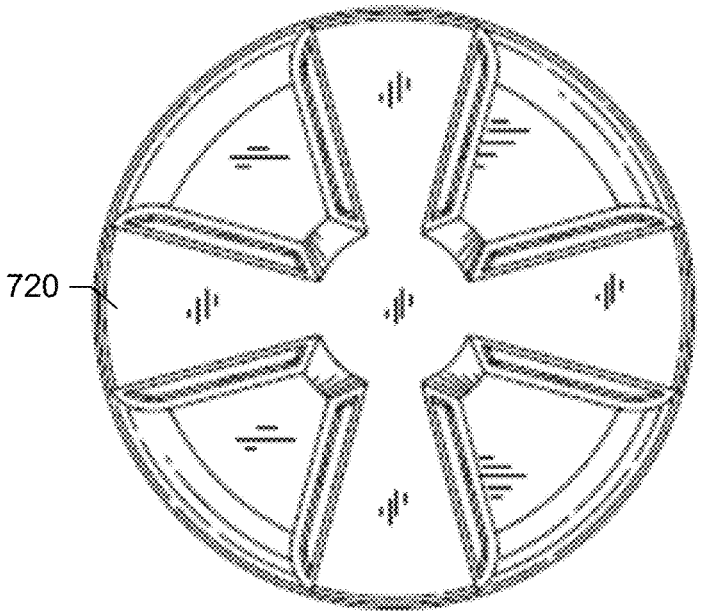
FIG. 9 shows a bottom view of the modular container shown in FIG. 7.
Figure 10:
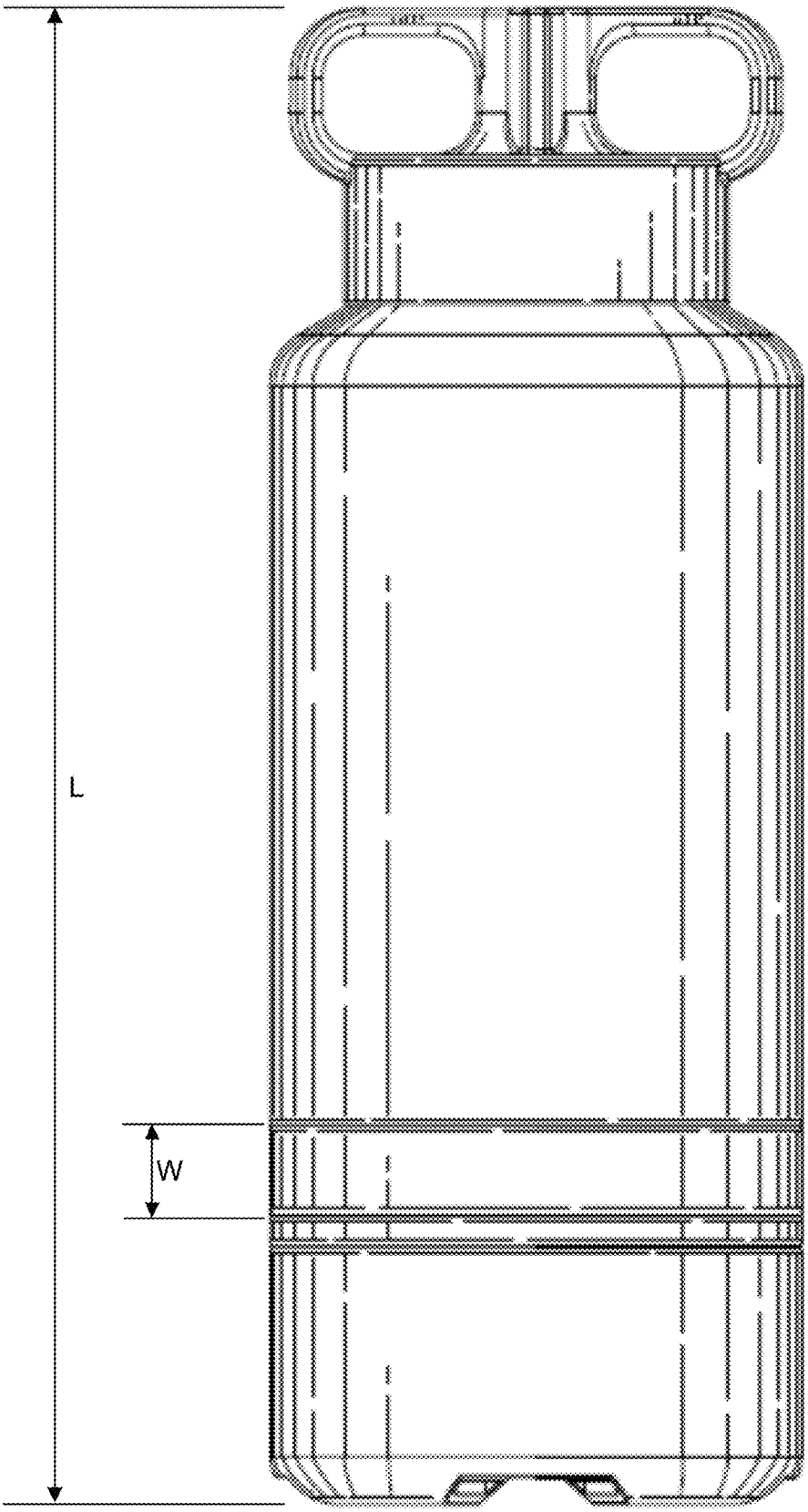
FIG. 10 shows a side view of the modular container shown in FIG. 7.
Figure 11:
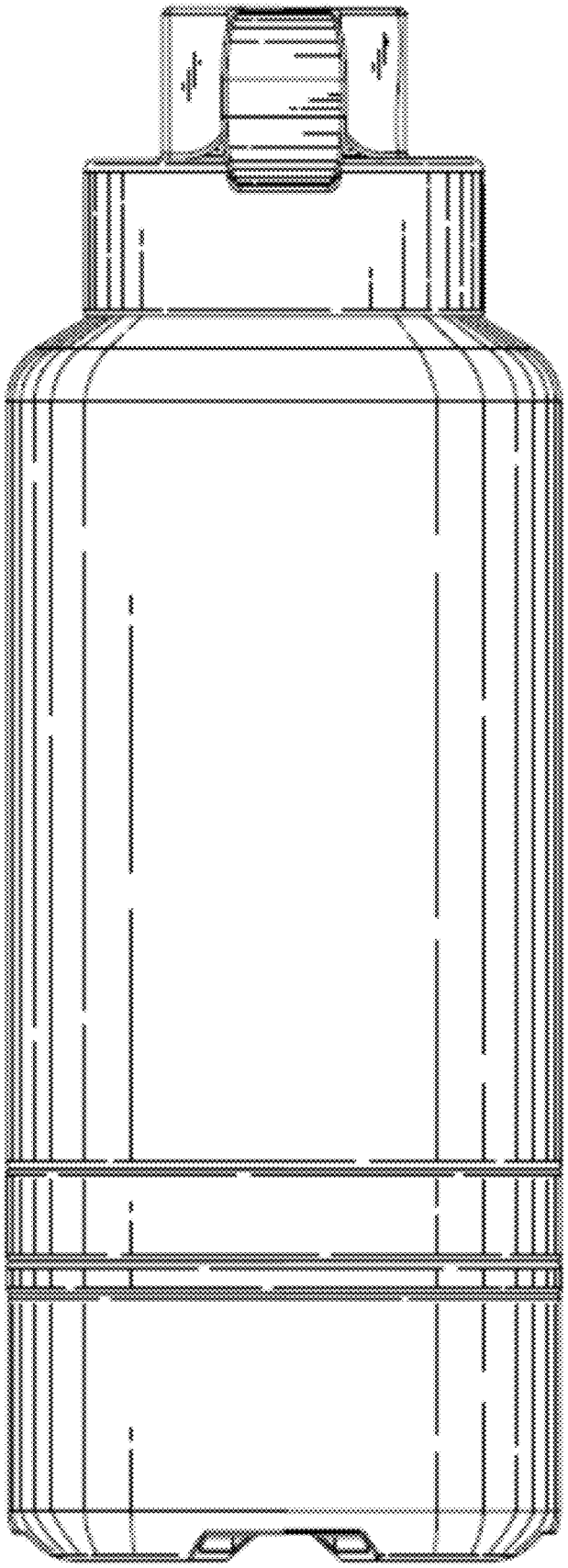
FIG. 11 shows another side view of the modular container shown in FIG. 7.
Figure 12:
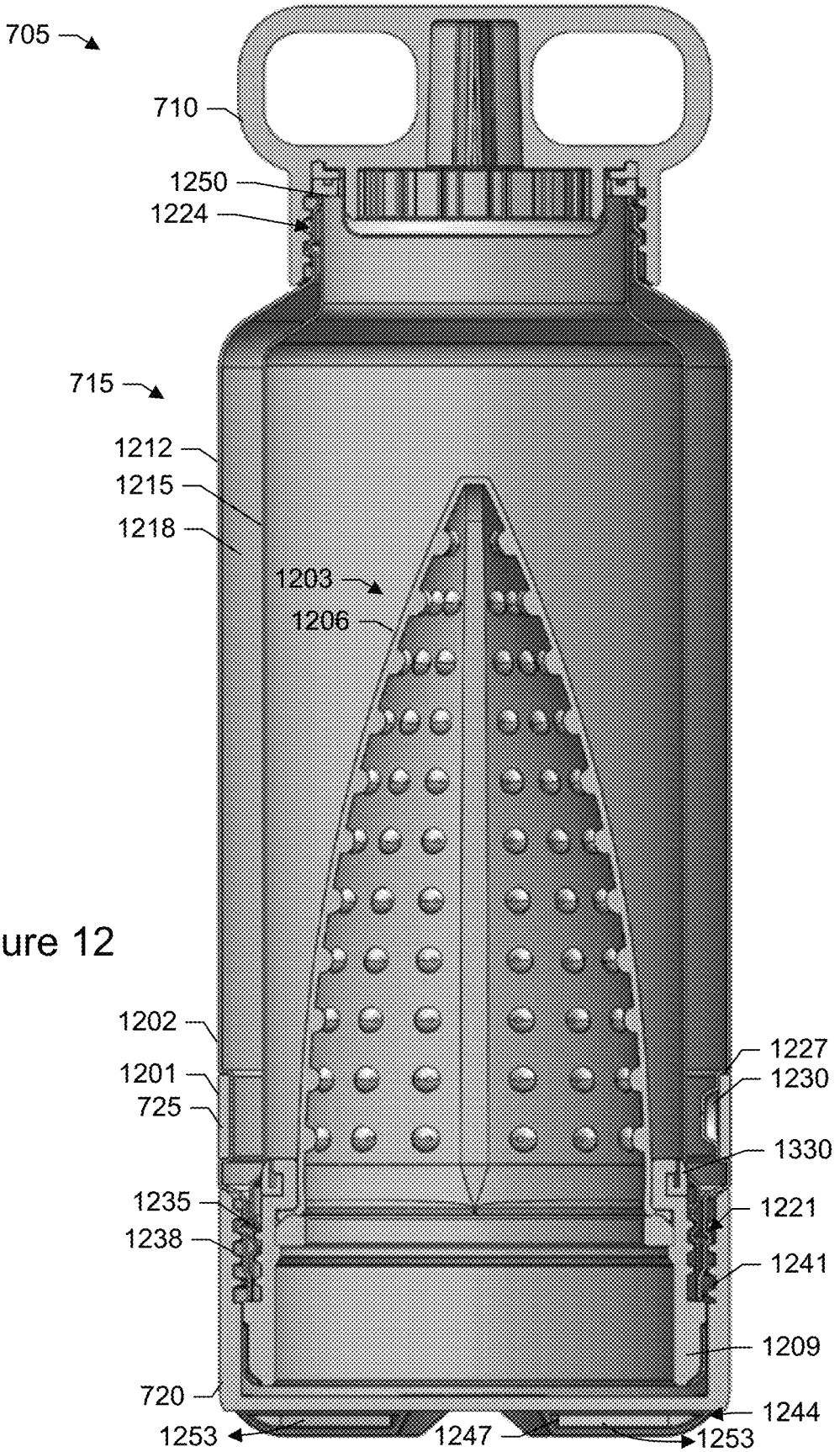
FIG. 12 shows a section view of a modular container having a double wall body according to a specific embodiment.

FIG. 7 shows a perspective view of a container 705 according to a specific embodiment. FIG. 8 shows a top view of the container shown in FIG. 7. FIG. 9 shows a bottom view of the container shown in FIG. 7. FIG. 10 shows a side view of the container shown in FIG. 7. FIG. 11 shows another side view of the container shown in FIG. 7. FIG. 12 shows a section view of the container shown in FIG. 10.

Referring back now to FIG. 7, in this specific embodiment, the container includes a top cap 710, a body 715, a bottom cap 720, and a band 725. Referring now to FIG. 12, in this specific embodiment, container 705 includes a bag assembly 1203. The bag assembly includes a bag 1206 and a sleeve 1209. The sleeve connects the bag assembly to container body 715. In this specific embodiment, the container body includes an outer shell 1212, an inner shell 1215, a vacuum insulated space 1218 between the inner and outer shells, a bottom neck 1221, a top neck 1224, opposite the bottom neck, a channel 1227, a vacuum port 1230, and band 725.

Figure 14:
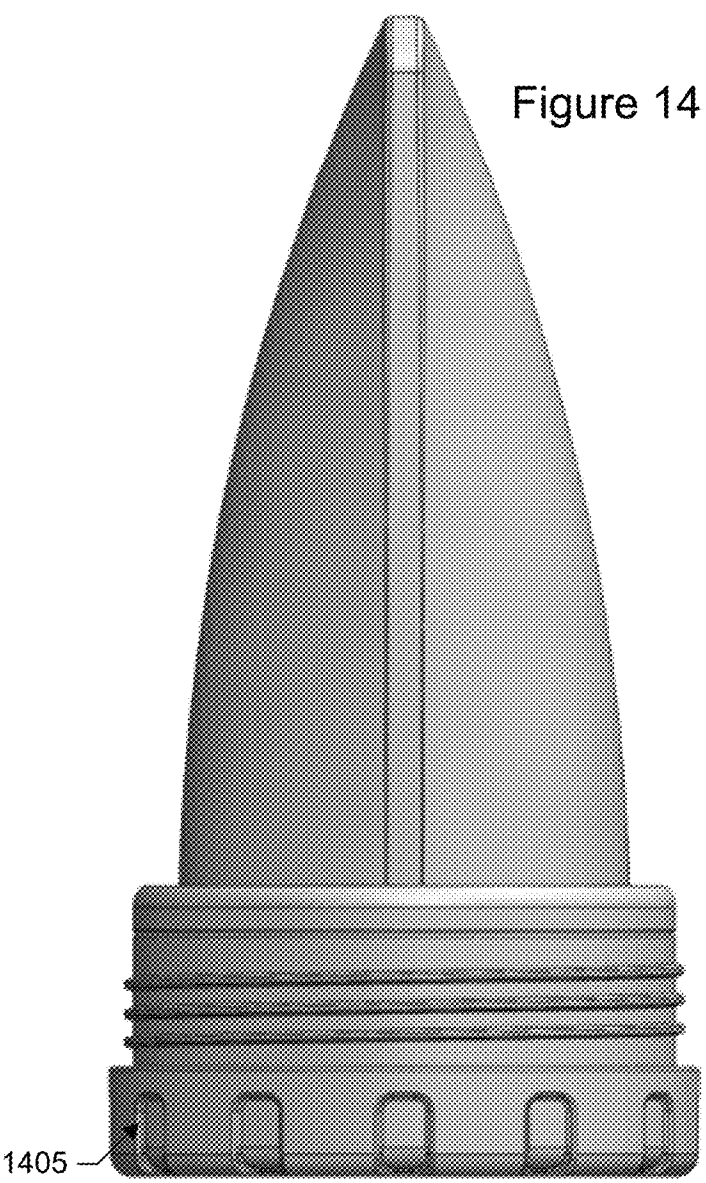
FIG. 14 shows a side view of the bag assembly shown in FIG. 13.
Figure 13:
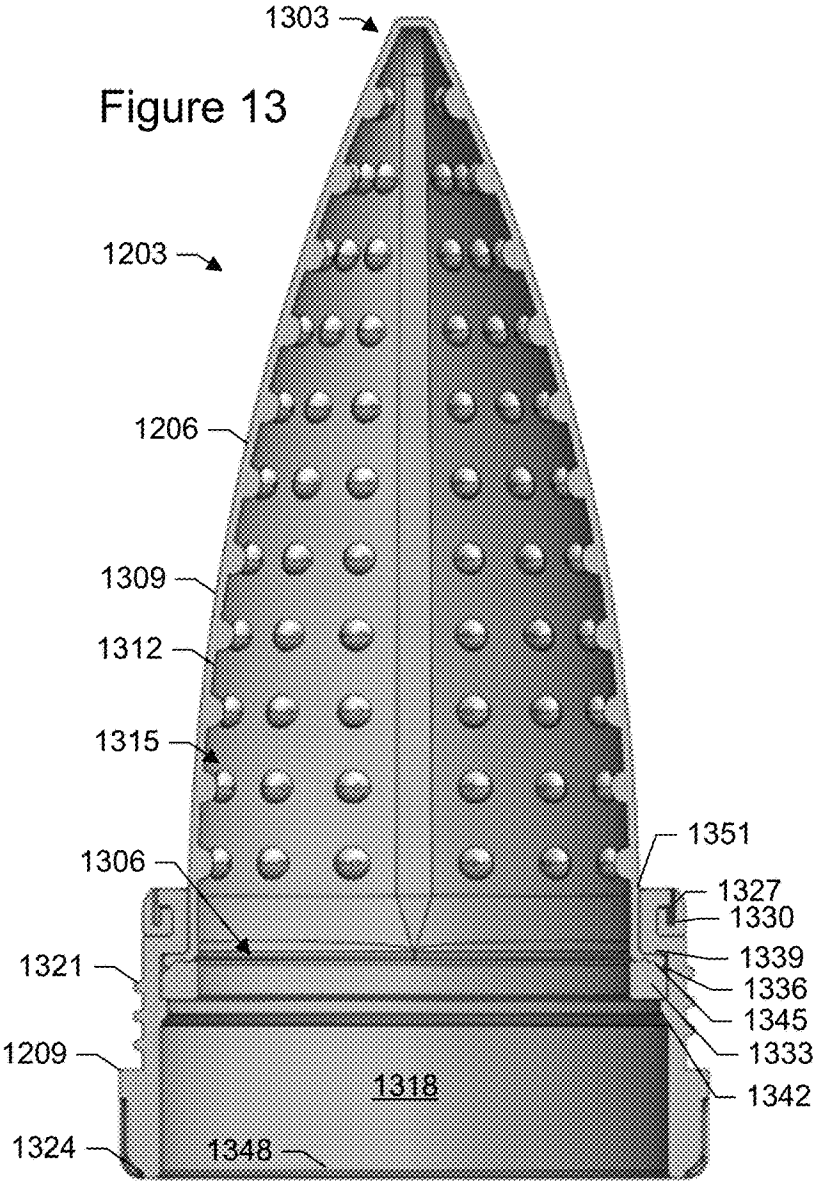
FIG. 13 shows a section view of a bag assembly according to a specific embodiment.

FIG. 13 shows an enlarged section view of bag assembly 1203 including bag 1206 and sleeve 1209 in isolation (e.g., having been detached from the bottom neck of the container body). FIG. 14 shows an outside view of the bag assembly shown in FIG. 13. Referring now to FIG. 13, the bag includes a closed end 1303, a bag opening 1306, opposite the closed end, an outside surface 1309, and an inside surface 1312, opposite the outside surface. In this specific embodiment, the outside surface is relatively smooth and continuous to facilitate cleaning; while the inside surface includes a surface texture 1315 that is rough or includes a series of bumps, knobs, or protrusions. Instead or additionally, the surface texture may include dimples, grooves, ridges, or other surface features.

The surface texture helps to ensure that the bag does not stick to any items that may be placed into the bag by reducing surface friction and facilitating air flow between the surface of the bag and the surface of the items. The surface texture may be optional and may not be included in some embodiments. In other words, in another specific embodiment, the inside surface may be smooth. In a specific embodiment, the bag is made of silicone. Other materials that the bag may be made from include plastic, latex, rubber, nylon, a polyester film, biaxially-oriented polyethylene terephthalate (BoPET) (e.g., Mylar®), or combinations of these. The bag may be referred to as a pouch.

The sleeve includes a passageway 1318, sleeve threads 1321, a grip portion 1324, a sleeve outside channel 1327, a sealing gasket 1330, a retaining ring 1333, and a sleeve inside channel 1336.

The bag is connected to the sleeve by an annular snap-fit formed by the retaining ring. Specifically, a shoulder 1339 and a ridge 1342 of the sleeve extend slightly into the passageway to define the inside channel of the sleeve. A rim 1345 of the bag is positioned and secured within the inside channel of the sleeve 1336 by the retaining ring. For example, to secure the bag and sleeve together, the closed end of the bag may be passed through the passageway from a bottom opening 1348 of the passageway and through a top opening 1351 of the passageway until the bag rim is positioned within the inside channel of the sleeve. The retaining ring may then be snap-fitted or interlocked into the sleeve by inserting the retaining ring through the bottom opening of the passageway and then pushing the retaining ring past ridge 1342. In other words, the ridge, retaining ring, or both resiliently or plastically deform or deflect as the retaining ring is pushed into the inside channel of the sleeve. The retaining ring compresses the bag rim against shoulder 1339 to create a water-tight seal.

An adhesive may instead or additionally be used connect the bag and sleeve together. In a specific embodiment, the bag and sleeve are designed to be permanently attached to each other. In another specific embodiment, the bag and sleeve are designed to be separated from each other. Separating the parts from each other can facilitate cleaning. Having a permanent connection, however, may reduce manufacturing costs as the parts will not have to be designed to withstand repeated disassembly and re-assembly.

The passageway extends through the sleeve and into the bag opening. It is generally desirable to have a large-sized passageway and bag opening in order to fit items through the passageway and into the bag. Thus, a size (e.g., diameter) of the bag opening may be about substantially similar to a size (e.g., diameter) of the passageway. A diameter of the bag opening may be about substantially similar to a diameter or inside diameter of the inner shell. A diameter of the bag opening may be about substantially similar to a diameter or inside diameter of the bottom cap.

A size of the bag opening may be different from or the same as a size of the top opening of the container body. In a specific embodiment, a size of the bag opening is greater than a size of the top opening of the container body. In other words, in this specific embodiment, the size of the top opening is less than a size of the bag opening. Limiting the size of the top opening can help to control the amount or rate of liquid that flows out of the top opening when the user is taking a drink. Increasing the size of the bottom opening (or bag opening and passageway) facilitates the ability to insert differently sized items into the bag.

In this specific embodiment, the sleeve threads are external threads on an outside of the sleeve and encircle the passageway. The sleeve threads are between the grip portion of the sleeve and the outside channel of the sleeve. The sleeve threads removably engage with a set of threads 1235 (FIG. 12) on an inside of bottom neck 1221.

Referring back now to FIG. 13, the grip portion of the sleeve provides a surface for the user to remove and attach the bag assembly to the container body. For example, to attach the bag assembly to the container body, the user inserts the bag of the bag assembly through a bottom opening 1505 (FIG. 15) of the container body defined by bottom neck 1221 so that the sleeve threads mate with the inside threads of the bottom neck. The user can hold the grip portion and turn the bag assembly relative to the container body to engage the sleeve threads with the inside threads of the bottom neck thus screwing the bag assembly onto the container body. The procedure can be reversed to detach the bag assembly from the container body. The grip portion of the sleeve may include surface texturing such as a set of indentations 1405 (FIG. 14) disposed about the outside surface of the sleeve. This surface texturing helps to prevent the user's hand from slipping while attaching or detaching the bag assembly.

Outside channel 1327 of the sleeve holds sealing gasket 1330. As shown in FIG. 12, when the bag assembly is secured to the bottom neck of the container body, sealing gasket 1330 helps to form a water-tight seal between an inside surface of the bottom neck and sleeve of the bag assembly to prevent any fluids or liquids contained in the container body from leaking out.

Bottom cap 720 is removably secured to the bottom neck of the container body. Specifically, the bottom neck of the container body includes a set of threads 1238 on an outside of the bottom neck. These threads may be referred to as bottom neck outside threads or external threads. Threads 1235 may be referred to as bottom neck inside threads or internal threads. As shown in the example of FIG. 12, these threads are on opposite sides of the bottom neck. Threads 1238 are on the outside of the bottom neck; while threads 1235 are on the inside of the bottom neck, opposite the outside of the bottom neck. The bottom neck outside threads may at least partially encircle or overlap the bottom neck inside threads.

The bottom cap includes threads 1241 that removably engage with the bottom neck outside threads to secure the bottom cap to the container body. The inside of the bag (e.g., storage compartment) can be accessed by unscrewing the bottom cap from the bottom neck to expose the bottom opening (e.g., opening of the bag and passageway). To store an item, the user can insert the item through sleeve passageway and into the bag opening. The user can then reattach the bottom cap to the bottom neck of the container body (e.g., screw bottom cap onto bottom neck) to secure the item in the bag.

In this specific embodiment shown in FIG. 12, the design of the bottom neck, bag assembly, and bottom cap allows the bottom cap to be decoupled independently from the bag assembly. That is, in this specific embodiment, the bottom cap is removably connected to the bottle body and not the bag assembly. The bottom cap can be removed (and reattached) without affecting the position of the bag assembly. This helps to ensure that the watertight seal between the bag assembly and inside surface of the bottom neck remains intact when the bottom cap is being attached and detached.

In this specific embodiment, the bottom cap includes a set of feet 1244 that form a base for the container. Each side surface of a foot includes a hole or slot 1247 in fluid communication with the inside of the bag (and sleeve passageway). Air in the bag is permitted to escape through the sleeve passageway and out through the hole in the bottom cap. In other words, when top cap 710 is removed and a drink is introduced into the container body through a top opening 1250, the weight of the drink on the bag at least partially collapses the bag around the stored item as air in the bag is permitted to escape 1253 through the sleeve passageway and out through the one or more holes in the bottom cap.

Locating the bottom cap holes on the side surfaces of the feet helps to prevent any small items that may be stored in the bag from inadvertently falling out. Since the holes are on the side surfaces, the items stored in the bag are unlikely to find a straight path out. Locating the holes on the side surfaces also helps to prevent the holes from becoming blocked by any surface that the container may be resting on. Having multiple small holes rather than a single large hole helps to allow the bag to collapse quickly and also helps to prevent any small items being stored from falling out.

In a specific embodiment, a shape of a bottom cap hole is slot-shaped or rectangle shaped. For example, a ratio of a length of a bottom cap hole to a width of the bottom cap hole may be about 2:1 or 3:1. Having a slot-shaped hole (as compared to a round or square hole) can also help to keep such small items from falling out by functioning as a screen. The bottom cap hole may be implemented as a mesh or screen.

Figure 16:
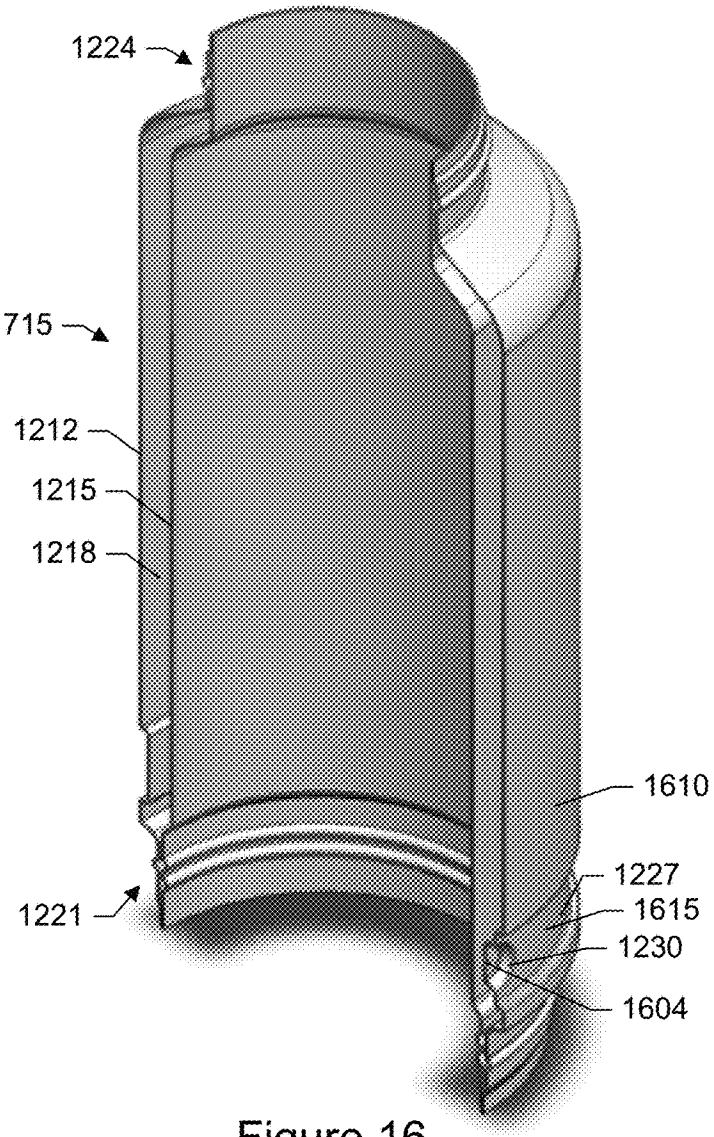
FIG. 16 shows a section view of the double wall body shown in FIG. 15.
Figure 15:
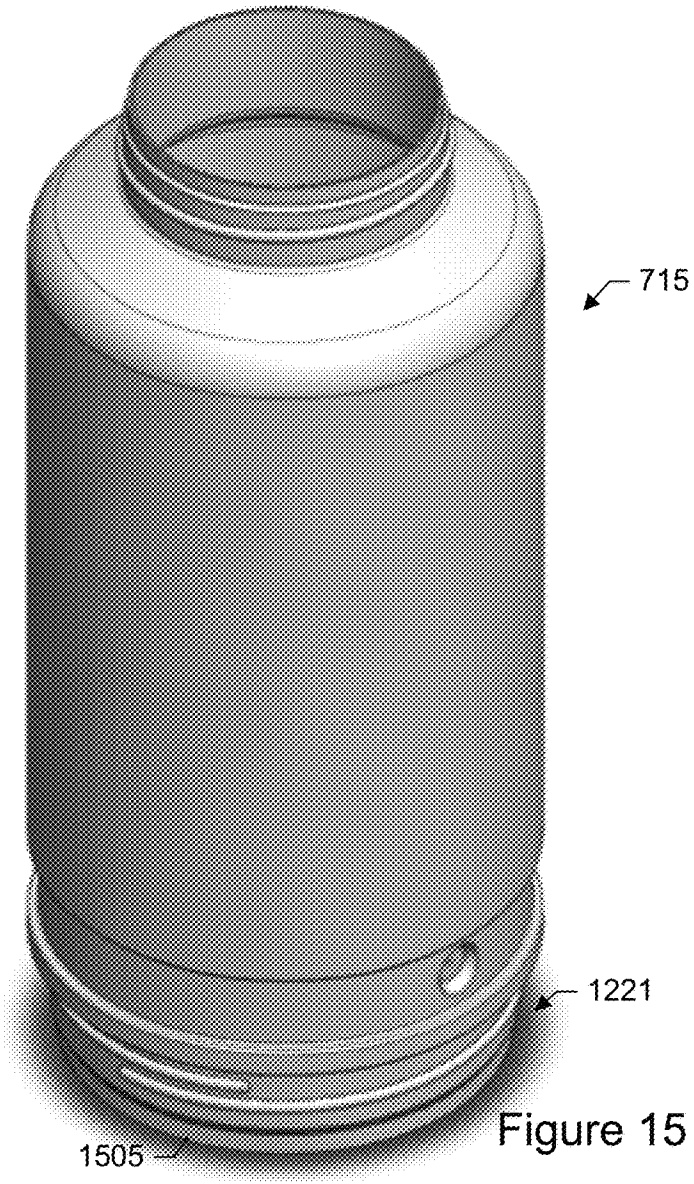
FIG. 15 shows a perspective view of the double wall body shown in FIG. 12.

FIG. 15 shows a perspective view of container body 715. FIG. 16 shows a section view of the container body shown in FIG. 15. As discussed, the container body includes outer shell 1212, inner shell 1215 that is encased by the outer shell, and vacuum space 1218 between the inner and outer shells. The vacuum space is created via vacuum port 1230.

In a specific embodiment, the container body is made by joining the inner and outer shells (joining at their corresponding rims), drilling a hole 1604 (FIG. 16) through a sidewall 1610 of the outer shell (or through a bottom 1615 of the channel) to form the vacuum port, at least partially evacuating the air between the inner and outer shells through the hole of the vacuum port to create the insulated vacuum space, and then sealing the vacuum port including the drilled hole.

Band 725 (shown in FIG. 12) is then placed over the vacuum port to cover the vacuum port. In this specific embodiment, the band encircles the container body and is positioned between the top and bottom caps. Channel 1227, into which the band is placed, provides a recess for the band and helps to ensure that the band does not accidentally slip off. In other words, the vacuum port is set back into the sidewall of the outer shell because the vacuum port is created within the channel. Generally, the depth of the channel is less than the gap, vacuum insulated space, or distance between the inner shell and the outer shell. In other words, the depth of the channel in the outer shell extends into the space or gap between the inner and outer shells but terminates before reaching, touching, or contacting the inner shell. The depth of the channel is sufficient to accommodate the vacuum port and suction equipment used to evacuate air between the inner and outer shells via the vacuum port.

In an embodiment, the depth of the channel and thickness of the band are designed so that when the band is placed within the channel, an outside surface 1201 of the band (FIG. 12) is flush with an outside surface 1202 of the outer shell. The depth of the channel may be equal to the thickness of the band when the band has been placed into the channel.

Having the band sit flush with the outside surface of the outer shell helps to ensure that the band does not inadvertently catch on other objects and helps to make the container easy to hold and grip. Further, the band can help to reduce post-processing finishing costs by reducing the need to cap and weld a cover over the channel and then file down the welds for a smooth and seamless appearance. Another factor in determining the depth of the channel can be the desired thickness of the band. That is, it is desirable to ensure that the band is sufficiently thick so that it will not be accidentally torn while being positioned and maintained in the channel. In a specific embodiment, a central or longitudinal axis passes through a container body. A first distance is from the central axis to an outside surface of the container body. A second distance is from the central axis to an outside surface of a band encircling the container body. The first and second distances are equal to each other.

The band may be made from silicone, plastic, rubber, or other competent material. The band may be designed to be permanently attached to the container body. For example, an adhesive may be used to permanently secure the band within the channel.

In a specific embodiment, the channel with the vacuum port is located on the sidewall of the outer shell. In other words, the channel is not located on a bottom end of the outer shell as the bottom of the outer shell is open. The channel with the vacuum port is between the top and bottom caps. In another specific embodiment, a first axis passes longitudinally through a center of the container body. A second axis is orthogonal to the first axis, intersects the first axis, and passes through a center of the vacuum port (with hole). In another specific embodiment, an angle between the vacuum port (with hole) and a surface upon which the bottom cap of the container rests is about 90 degrees. The vacuum port (with hole) is located on the sidewall of the outer shell and thus does not face the surface upon which the bottom cap of the container rests.

In a specific embodiment, the channel with the vacuum port is closer to bottom neck 1221 than top neck 1224. That is, a distance between the channel with the vacuum port to the bottom neck is less than a distance between the channel with the vacuum port to the top neck. A distance between the channel with the vacuum port to the top neck is greater than a distance between the channel with the vacuum port to the bottom neck.

The channel with the vacuum port, however, may be located anywhere along the length of the container body. For example, in other specific embodiments, the channel with the vacuum port may be closer to the top neck than the bottom neck. That is, a distance between the channel with the vacuum port to the bottom neck may be greater than a distance between the channel with the vacuum port to the top neck. A distance between the channel with the vacuum port to the top neck may be less than a distance between the channel with the vacuum port to the bottom neck. The channel with the vacuum port may be positioned equidistance between the top and bottom necks. That is, a distance between the channel with the vacuum port to the bottom neck may be equal to a distance between the channel with the vacuum port to the top neck.

In FIG. 10, a dimension L indicates an overall length of the container. A dimension W indicates a width of the channel (and accompanying band). In a specific embodiment, a ratio of the width to length is about 1:18. The ratio, however, may vary greatly. For example, the ratio may be about 1:5, 1:7, 1:9, 1:10, 1:12, 1:14, 1:16, and so forth. The length may be less than 5 times greater than the width. The length may be more than 5 times greater than the width. The length may be less than 18 times greater than the width. The length may be more than 18 times greater than the width.

A band that is wide relative to the length of the container can provide a large tacky area for the user to grip. For example, in a specific embodiment, the band is made of silicone while the container body is made of stainless steel. Silicone can be tackier than stainless steel and thus easier to grip than stainless steel. In a specific embodiment, the band is a jacket that is designed to cover a substantial portion of the container body. In this specific embodiment, a width of the channel likewise extends over a substantial length of the container body (e.g., extends more than 40, 50, or 60 percent of the length of the container body). In this specific embodiment, the jacket forms a gripping surface for the user to grasp. The jacket may be made of silicone, rubber, or other insulating material to help insulate the contents stored in the container. (see, e.g., FIG. 29).

The channel and band can be optional and may not be present in other embodiments. For example, in another specific embodiment, rather than forming a channel for the vacuum port, the vacuum port (with hole) may be formed directly on the outer most surface of the outer shell. In this specific embodiment, there can be a plug that may be inserted into the vacuum port to cover the vacuum port. The plug may be designed with an appropriate thickness so that an outside surface of the plug will sit flush with the outside surface of the outer shell. As another example, in another specific embodiment, after air between the inner and outer shells has been at least partially evacuated to create the vacuum insulated space, the vacuum port may be filled with a filler material, such as epoxy or weld material, to cover the vacuum port. The omission of the channel, however, may result in additional post-processing costs to provide the container with a finished appearance and smooth surface. Nonetheless, in some cases, these additional post-processing costs may be acceptable to achieve a certain aesthetic look-and-feel. (see, e.g., FIG. 30).

In a specific embodiment, the container body including the inner and outer shells are made of a rigid non-flexible material such as metal or, more specifically, stainless steel. In other specific embodiments, other competent materials or combination of materials may be used (e.g., titanium, aluminum, plastic, and so forth). The top cap, bottom cap, or both may made from plastic.

Table A below shows a flow for making the container body according to a specific embodiment.

TABLE A

| Step | Description |
|---|---|
| 1 | Obtain raw lengths of first and second hollow tubes for the inner and outer shells, respectively. |
| 2 | Depending upon the desired thickness or gauge for the shells, pressure form one or both tubes to reduce the starting thickness of the tubes. |
| 3 | Rough cut the first and second tubes to a desired length for a single container body. |
| 4 | Pressure form a top neck at ends of the first and second tubes. |
| 5 | Pressure form a bottom neck at opposite ends of the first and second tubes. |
| 6 | Pressure form a channel within a sidewall of the second tube (i.e., outer shell). |
| 7 | Trim lengths of the first and second tubes. |
| 8 | Drill hole in the channel and through a sidewall of the second tube (i.e., outer shell) to form the vacuum port. |
| 9 | Roll form a first set of threads at a top end of the second tube (i.e., outer shell) for the top neck to threadably engage with the top cap. |
| 10 | Roll form a second set of threads at a bottom end of the first tube (i.e., inner shell) for the bottom neck to threadably engage with the sleeve of the bag assembly. |
| 11 | Roll form a third set of threads at a bottom end of the second tube (i.e., outer shell) for the bottom neck to threadably engage with the bottom cap. |
| 12 | Apply a coat of copper or copper sheeting to one or more surfaces of the first tube, second tube, or both to enhance insulating properties (e.g., apply copper coating to an outside surface of the first tube or inner shell). |
| 13 | Insert the first tube (i.e., inner shell) into the second tube (i.e., outer shell) so that the top rim or end of the first tube is aligned with the corresponding top rim or end of the second tube, and the bottom rim or end of the first tube is aligned with the corresponding bottom rim or end of the second tube. |
| 14 | Weld the corresponding top rims of the first and second tubes (i.e., inner and outer shells) together. |
| 15 | Weld the corresponding bottom rims of the first and second tubes (i.e., inner and outer shells) together. |
| 16 | Evacuate air between the first and second tubes (i.e., inner and outer shells) via the drilled hole in the channel to form a vacuum insulated space. |
| 17 | Seal the drilled hole. |
| 18 | Perform quality control (QC) testing to ensure that the vacuum is consistent and that there are no leaks. |
| 19 | Apply finishes (e.g., polishing, painting, screen printing, etchings, and so forth) as desired. |
| 20 | Stretch a band (e.g., silicone band) over the outer shell and position the band within the channel to cover the vacuum port. |

It should be appreciated that the above steps may not necessarily be performed in the order listed above, some steps may be performed concurrently, simultaneously, or in parallel with other steps, there can be additional steps, different steps which replace some of the steps presented, fewer steps or a subset of the steps presented, or steps in a different order than presented, or any combination of these. Some steps presented may be optional and not included in other embodiments. For example, the copper coating (step 12) may be optional and not included in some embodiments. As another example, the starting thickness or gauge of the first hollow tube, second hollow tube, or both may already be at the desired finished thickness or gauge. In this case, step 2 may not be present in some embodiments. As another example, rather than obtaining tubes, sheets of material may instead be obtained and rolled and welded to form tubes. As another example, there can be a non-insulated single wall container in which steps 14-17 (and other steps) may not be performed. As another example, the pressure forming may be performed using hydroforming, pressing, bulge forming, or any other competent process, or combination of processes.

Figure 17:
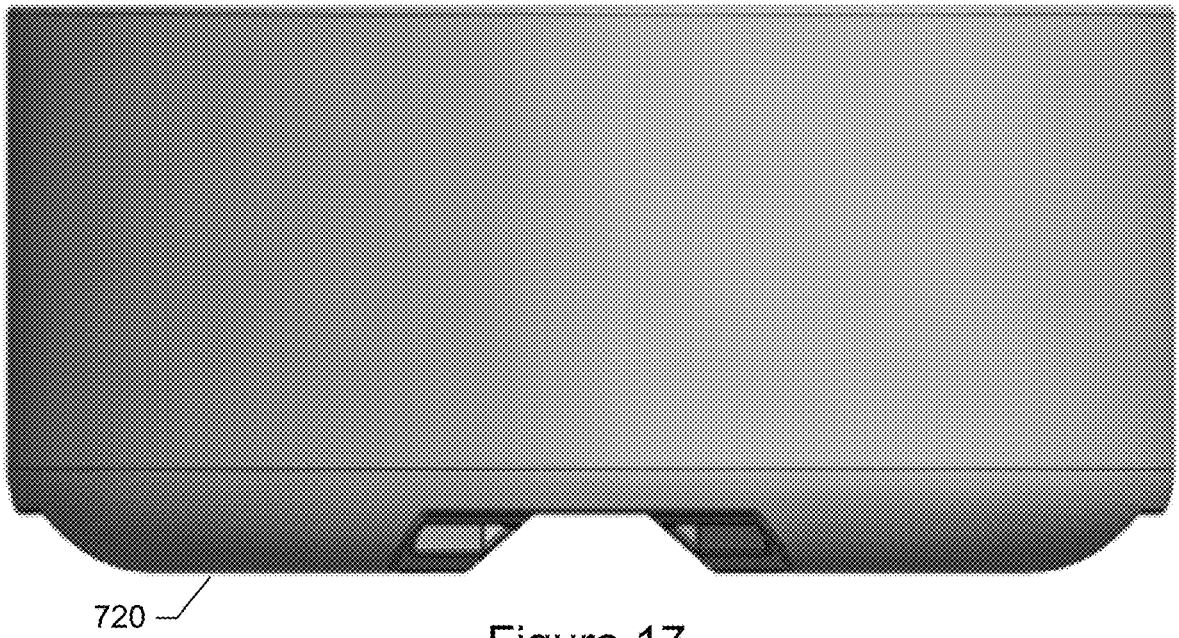
FIG. 17 shows a side view of a bottom cap according to a specific embodiment.
Figure 18:
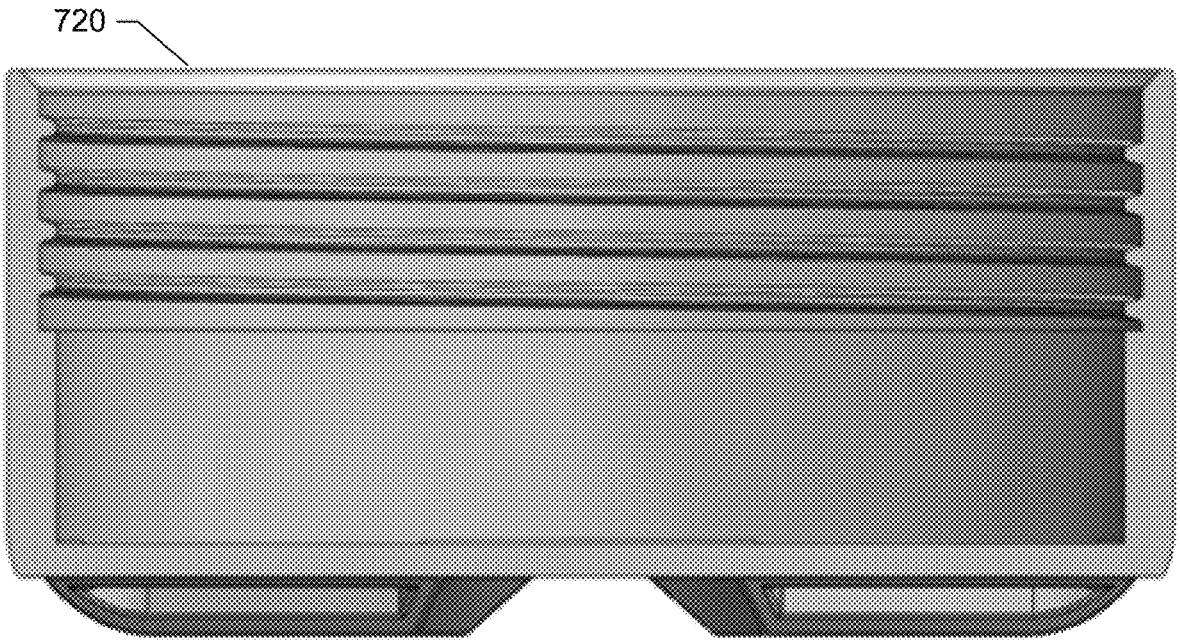
FIG. 18 shows a section view of the bottom cap shown in FIG. 17.

FIG. 17 shows a side view of bottom cap 720 in isolation. FIG. 18 shows a section view of bottom cap 720 shown in FIG. 17.

Figure 19:
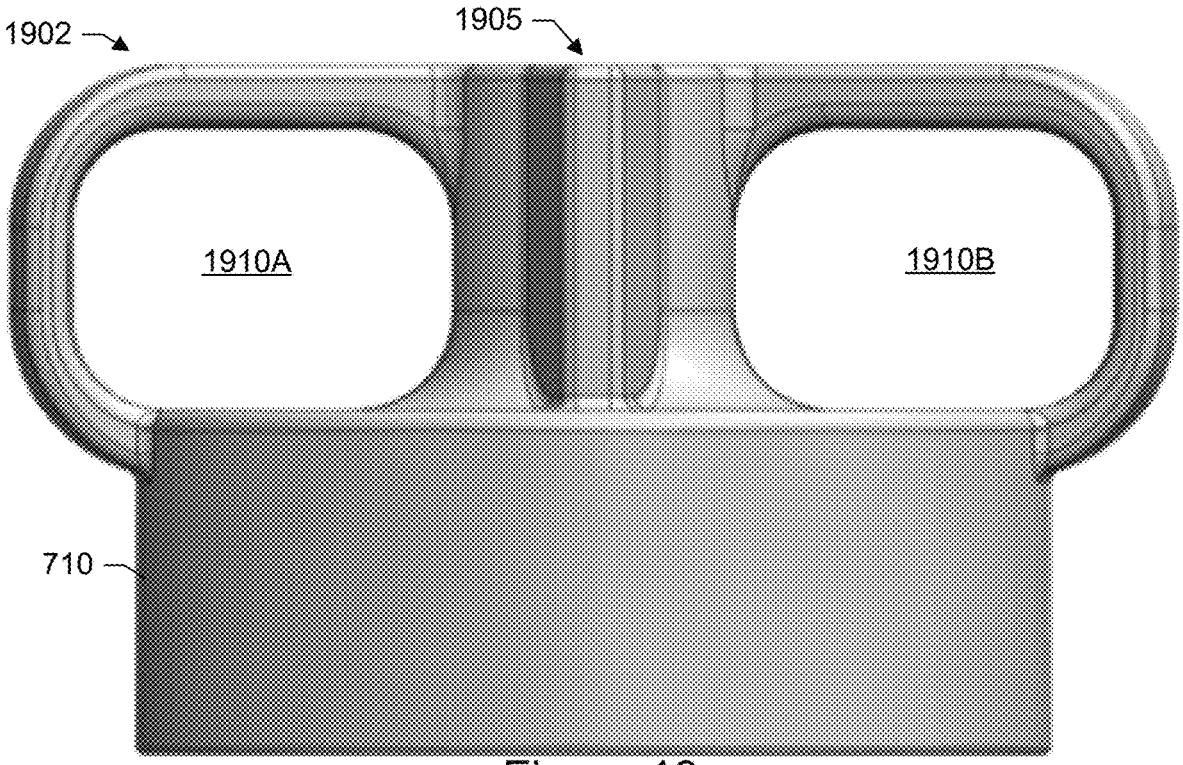
FIG. 19 shows a side view of a top cap according to a specific embodiment.
Figure 20:
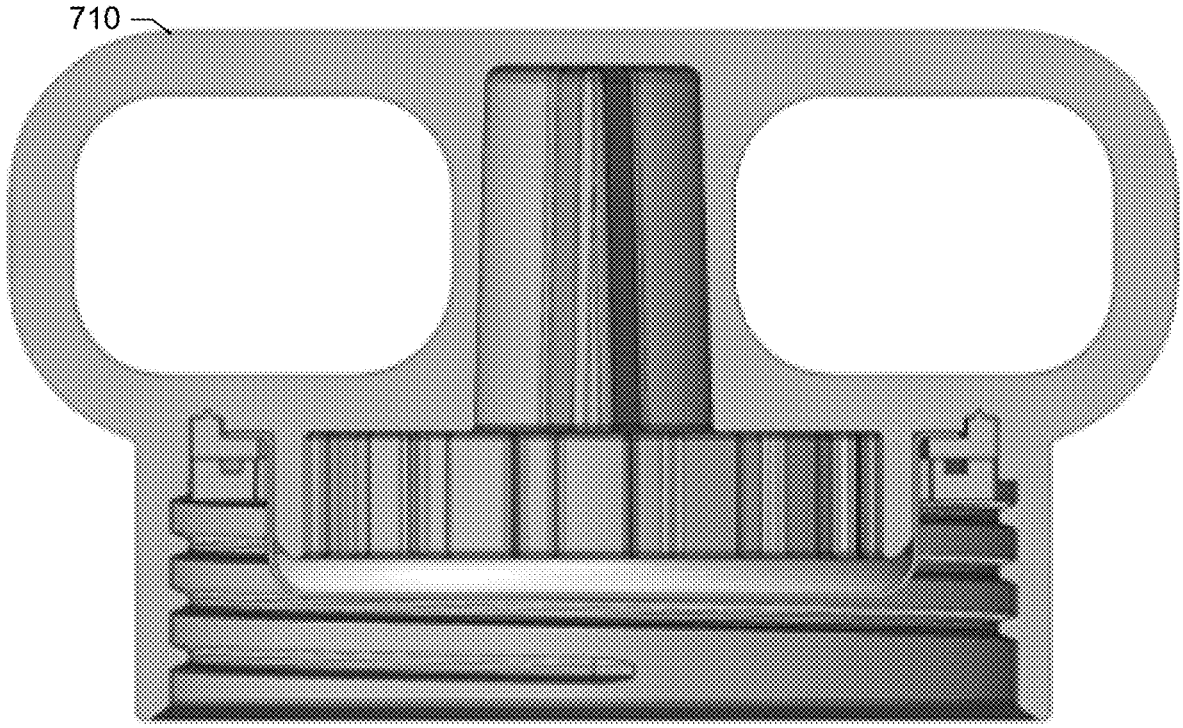
FIG. 20 shows a section view of the top cap shown in FIG. 19.

FIG. 19 shows a side view of top cap 710 in isolation. The top cap includes a set of handles 1902 and a set of extensions 1905 (extending into and out of the drawing sheet). The handles of the set of handles are opposite each other. The user can carry the container by inserting their fingers through finger holes 1910A-B of the handles. The extensions of the set of extensions are opposite each other. In a specific embodiment, top surfaces of the handles and extensions are flat so that the top cap can provide a base when the container is flipped upside down to access the bottom opening. The extensions further stabilize the container when flipped upside down to help prevent the container from tipping. FIG. 20 shows a section view of bottom cap 710 shown in FIG. 19.

Figure 21:
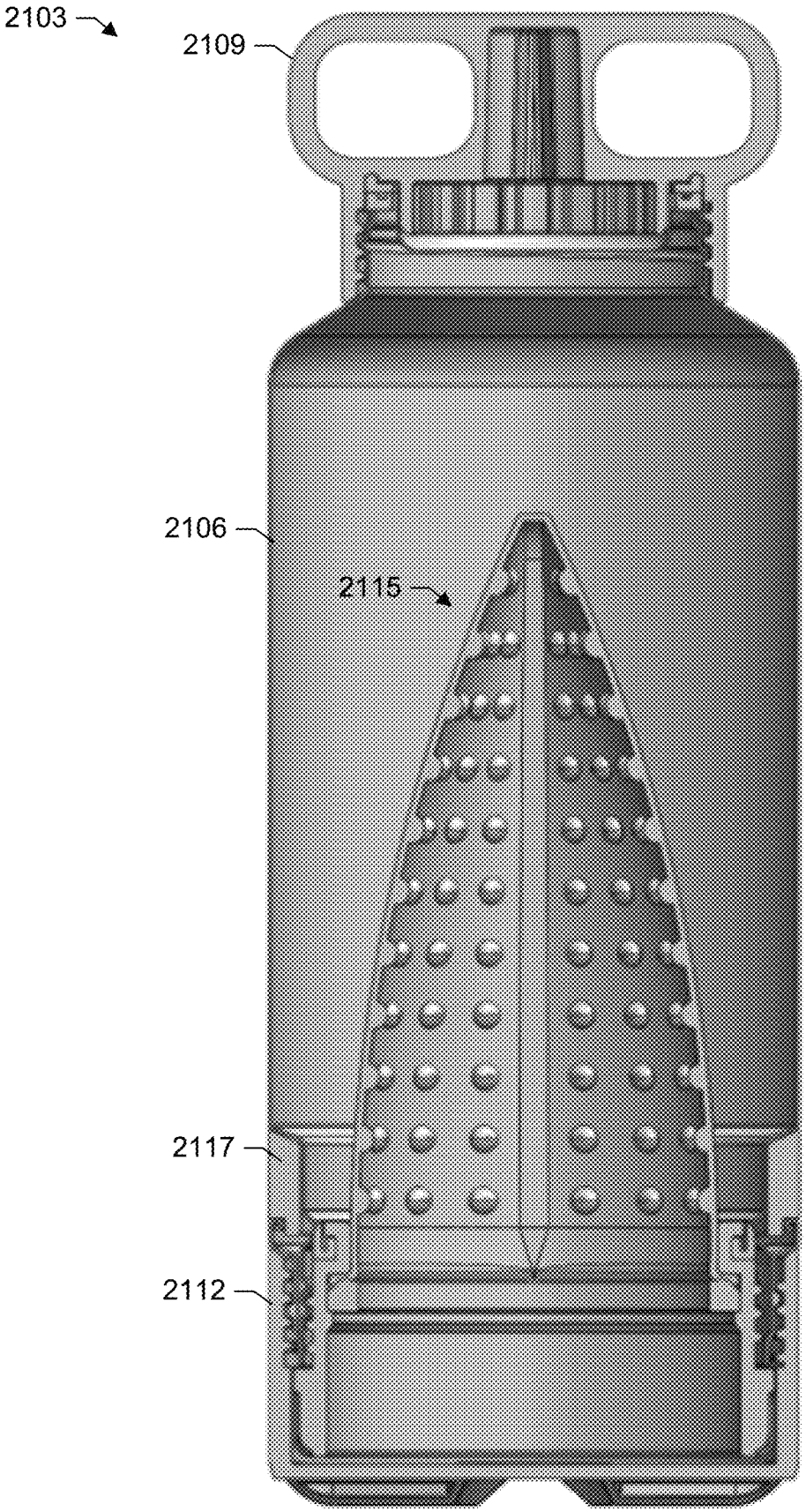
FIG. 21 shows a section view of a modular container having a single wall body according to a specific embodiment.

FIG. 21 shows a section view of a container 2103 according to another specific embodiment. The container shown in FIG. 21 is similar to the container shown in FIG. 12. The container shown in FIG. 12, however, includes body 715 that is of a double wall design; whereas a container body 2106 as shown in FIG. 21 is of a single wall design. Nonetheless, the containers shown in FIGS. 21 and 12 are designed with modular parts that can be interchanged or reused between the container bodies. This feature helps to reduce manufacturing and other costs (e.g., mold costs) because both the single wall and double wall container bodies can use the same parts such as the same top cap, bottom cap, bag assembly, or combinations of these.

For example, the container shown in FIG. 21 includes a top cap 2109, a bottom cap 2112, a bag assembly 2115, and a band 2117. Top cap 2109 (as shown with the single wall container body of FIG. 21) may be identical to top cap 710 (as shown with the double wall container body of FIG. 12). In other words, the molds used to produce top cap 2109 and top cap 710 may be the same.

Bottom cap 2112 (as shown with the single wall container body of FIG. 21) may be identical to bottom cap 720 (as shown with the double wall container body of FIG. 12). In other words, the molds used to produce bottom cap 2112 and bottom cap 720 may be the same.

Bag assembly 2115 (as shown with the single wall container body of FIG. 21) may be identical to bag assembly 1203 (as shown with the double wall container body of FIG. 12). In other words, the molds used to produce bag assembly 2115 and bag assembly 720 may be the same.

The modular design also provides the user with a range of cost-effective options to have different configurations of the container depending upon the user's particular needs at a particular time. For example, a user may purchase an insulated container body (e.g., double wall container body) and a non-insulated container body (e.g., single wall container body), but may purchase just a single set of top and bottom caps and bag assembly. Because of the modular design, the top and bottom caps and bag assembly can be reused for both the double and single wall container bodies. On some days, the user may select the single wall container body for its lightweight. On other days, the user may select the double wall container body for its insulating properties. The same top and bottom caps and bag assembly can be used for each case. The user does not need to purchase separate top and bottom caps and bag assembly for each case or configuration. Rather, the user is able to swap these parts between the two container body types.

Figure 23:
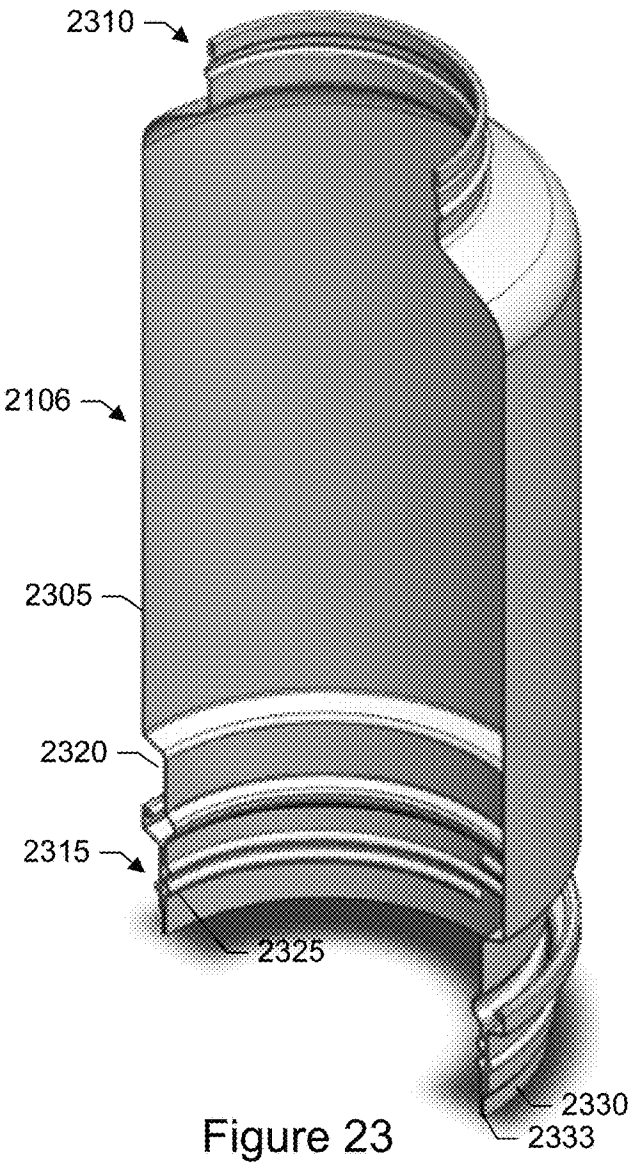
FIG. 23 shows a section view of the single wall body shown in FIG. 22.
Figure 22:
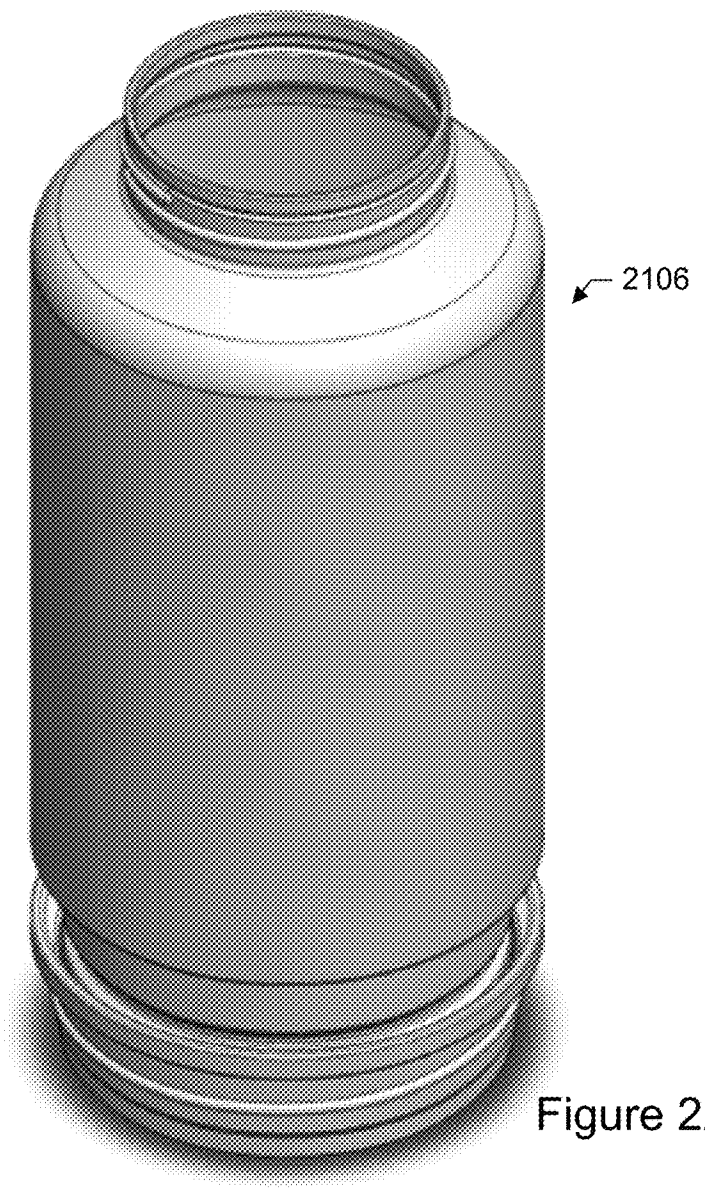
FIG. 22 shows a perspective view of the single wall body shown in FIG. 21.

FIG. 22 shows a perspective view of container body 2106 shown in FIG. 21. FIG. 23 shows a section view of container body 2106. Container body 2106 includes a single shell 2305, a top neck 2310, and a bottom neck 2315, opposite the top neck. Top neck 2310 of the single wall container design may be manufactured using a process similar to the manufacture of top neck 1224 of the double wall container design.

Bottom neck 2315 for the single wall container design may be manufactured by forming a channel 2320 and a set of bottom neck threads 2325 on an inside of the bottom neck. Threads 2325 may be referred to as inside bottom neck threads. Threads 2330 are on an outside of the bottom neck. Threads 2330 may be referred to as outside bottom neck threads. The outside bottom neck threads may be formed from a piece of material or short section of tubing separate from the tube used to form the container body and then joined (e.g., welded) along a seam 2333 to the container body.

In another specific embodiment, there can be a single piece of tubing in which portion of an end of the tubing is flipped or turned inside out for the outside bottom neck threads.

Figure 24:
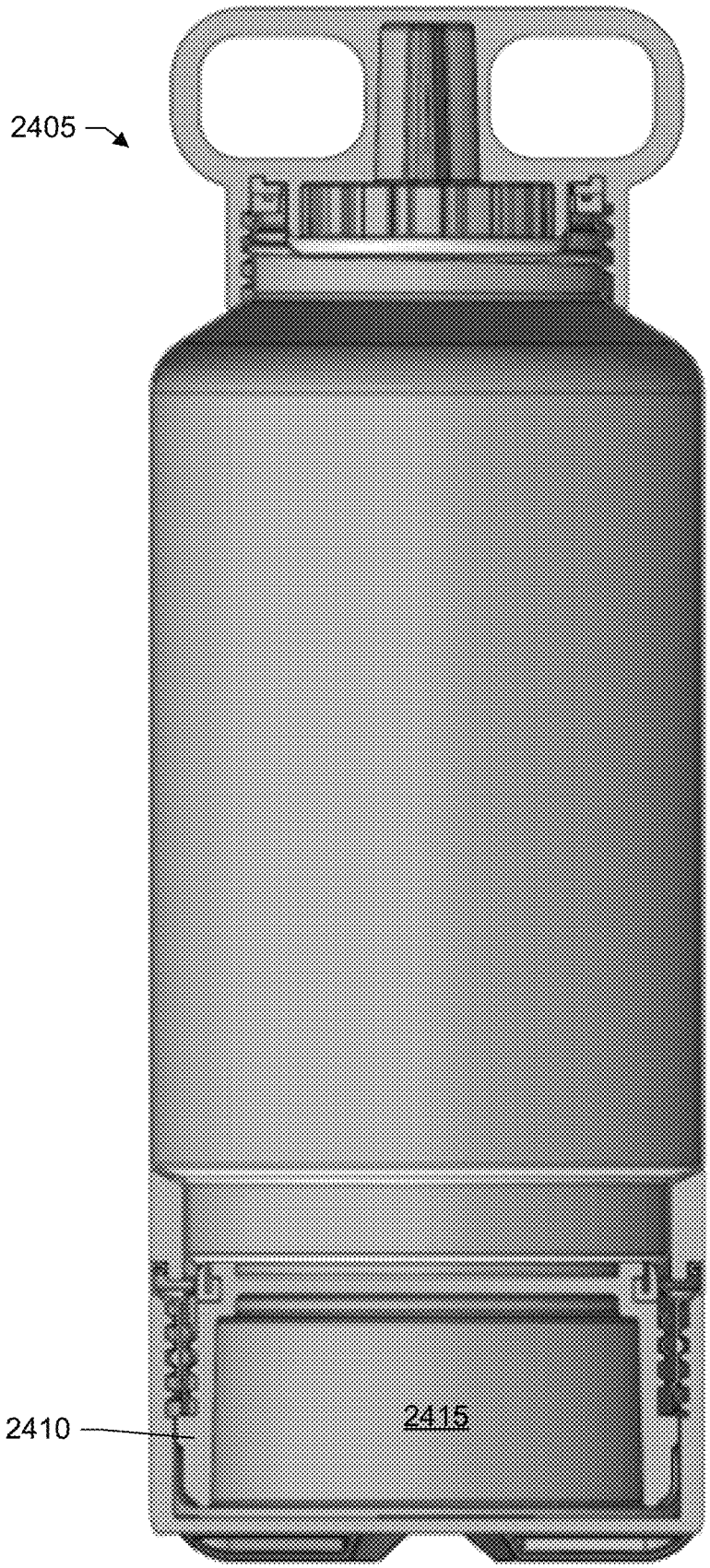
FIG. 24 shows a section view of a modular container having a single wall body and a fixed storage compartment according to a specific embodiment.

FIG. 24 shows a section view of a container 2405 according to another specific embodiment. The container shown in FIG. 24 includes an insert 2410 having a fixed storage compartment 2415. The insert having the fixed storage compartment replaces the bag assembly having the adjustable storage compartment provided by the bag. The insert may be referred to as a plug.

Figure 25:
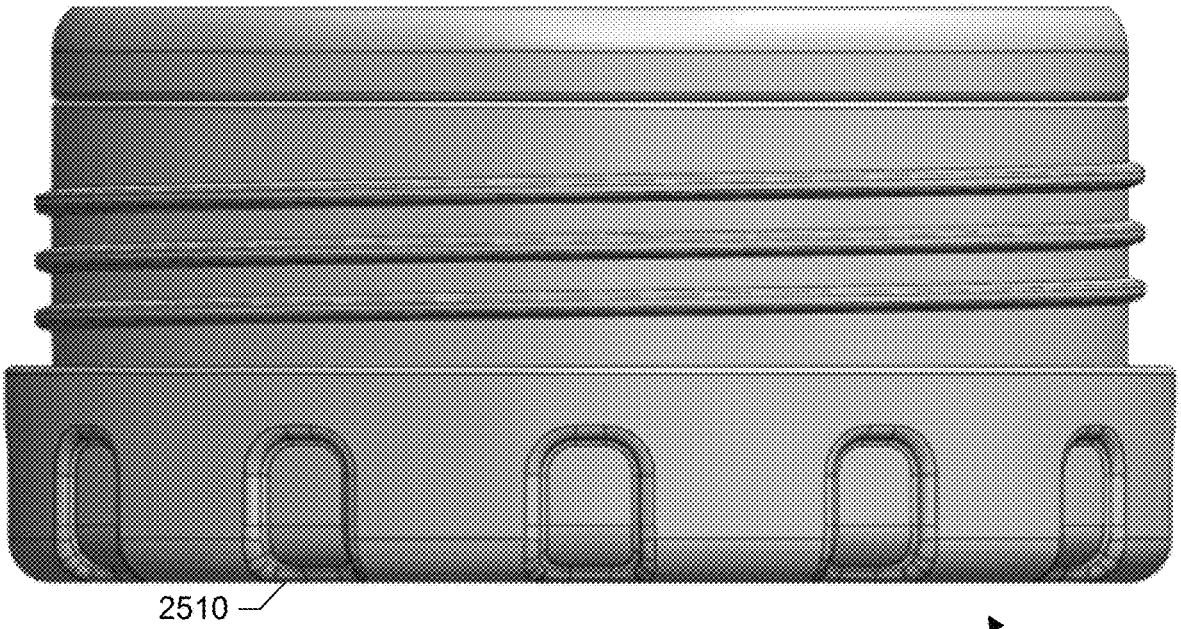
FIG. 25 shows a side view of a container insert having the fixed storage compartment shown in FIG. 24.
Figure 26:
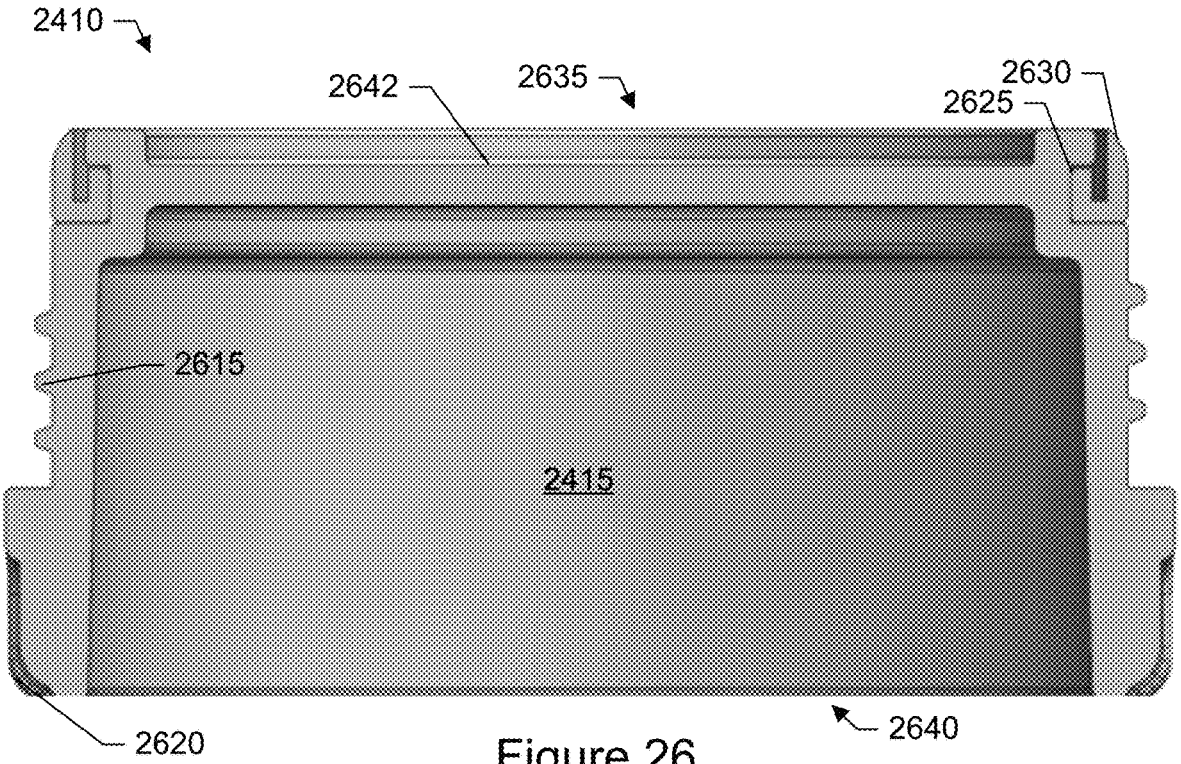
FIG. 26 shows a section view of the container insert shown in FIG. 25.

FIG. 25 shows an enlarged side view of insert 2410 in isolation. FIG. 26 shows an enlarged section view of insert 2410 shown in FIG. 25. The insert is similar to the bag assembly sleeve shown in FIGS. 13-14, but does not include a bag. For example, the insert includes a set of threads 2615 on an outside of the insert, a grip portion 2620 below the set of threads, an insert channel 2625 above the set of threads, and a sealing gasket 2630 retained by the insert channel.

Similar to the bag assembly sleeve, insert threads 2615 removably engage with the inside bottom neck threads of the container body. Sealing gasket 2630 compresses against the inside surface of the bottom neck to form a watertight seal. Grip portion 2620 of the insert includes a set of indentations 2510 (FIG. 25) to help the user grip the insert when attaching or detaching the insert from the container body. The insert, however, does not include a bag. Rather, the insert includes a top end 2635, opposite an open bottom end 2640, that is closed. That is, there is a rigid platform or roof 2642 that spans across the top end of the insert. The height of the fixed storage compartment extends between the roof and open bottom end 2640 and the diameter of the fixed storage compartment is defined by the diameter of open bottom end 2640.

Fixed storage compartment 2415 can be accessed by removing the bottom cap. In other words, the bottom cap covers the open bottom end of the insert to retain any items placed inside the fixed storage compartment.

When the insert is positioned in the container body, the closed top end of the insert faces the top cap of the container, and the open bottom end of the insert faces the bottom cap of the container. A first distance between the platform of the insert and the top cap is greater than a second distance between the platform of the insert and the bottom cap. A first side of the platform of the insert defines a bottom portion of a first chamber of the container. A second side, opposite the first side, of the platform of the insert defines a top portion of a second chamber of the container. In another specific embodiment, a first distance between the platform of the insert and the top cap is less than a second distance between the platform of the insert and the bottom cap. In this specific embodiment, the volume of the storage compartment may be greater than the volume of the drink compartment. In another specific embodiment, a first distance between the platform of the insert and the top cap is equal to a second distance between the platform of the insert and the bottom cap. In this specific embodiment, the volume of the storage compartment may be equal to the volume of the drink compartment.

Figure 27:
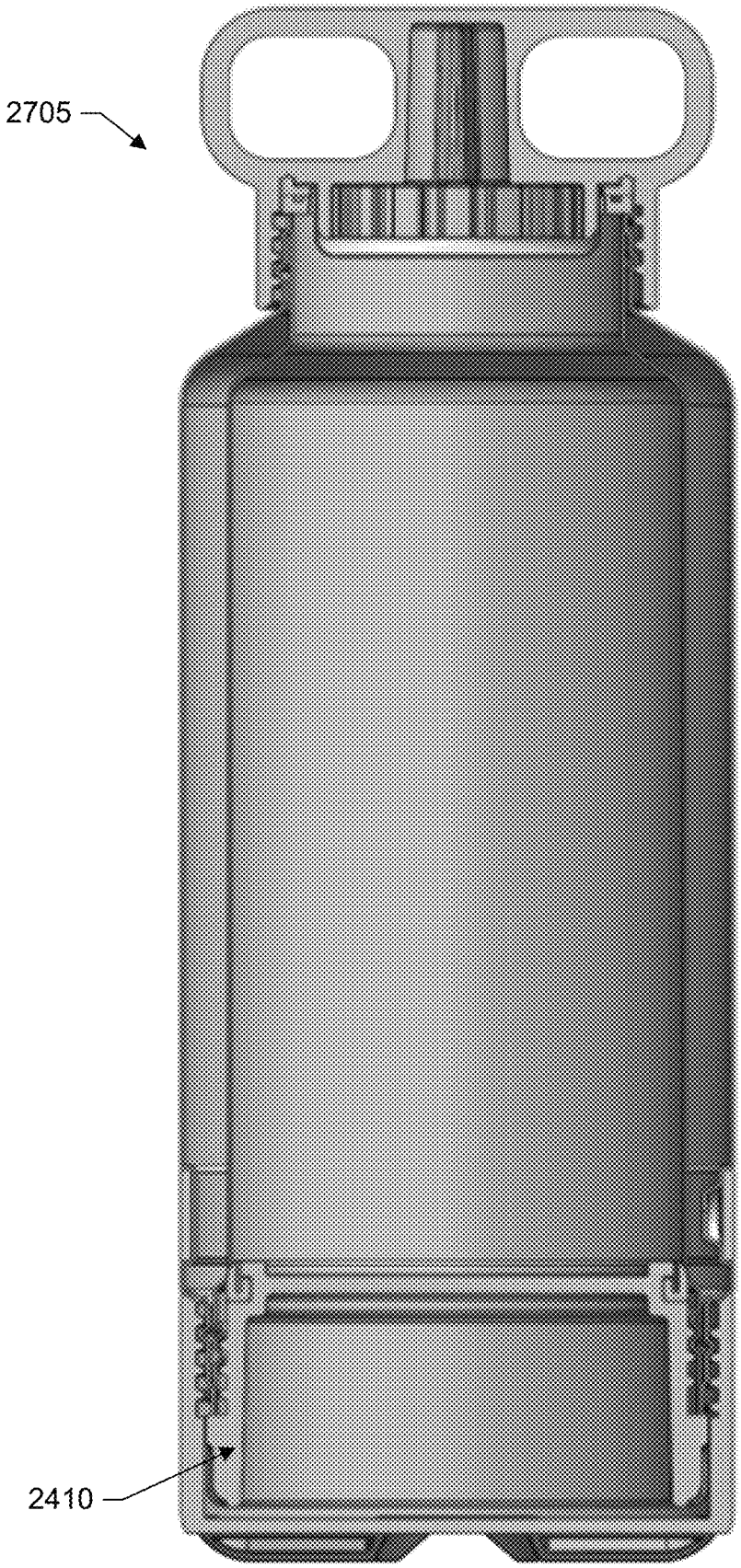
FIG. 27 shows a section view of a modular container having a double wall body and the container insert shown in FIG. 25.

The insert (having the fixed storage compartment) and bag assembly (having the adjustable storage compartment) can be used interchangeably with the single wall and double wall container designs. For example, FIG. 27 shows a container 2705 having an insulated double wall container body and insert 2410.

As discussed, the design of the container is modular such that parts (e.g., top cap, bottom cap, bag assembly, insert, or combinations of these) are interchangeable or reusable to allow the user to configure the container in many different ways. For example, the user may configure their double wall or single wall container with an adjustable storage compartment by attaching the bag assembly to the bottom neck of the container. Alternatively, the user may reconfigure that same container with a fixed storage compartment by replacing the bag assembly with the insert. The same top and bottom caps can be used with either configuration. The user does not have to purchase a separate container. The design of the container allows the user to configure the container with an adjustable storage compartment or a fixed storage compartment.

Figure 28:
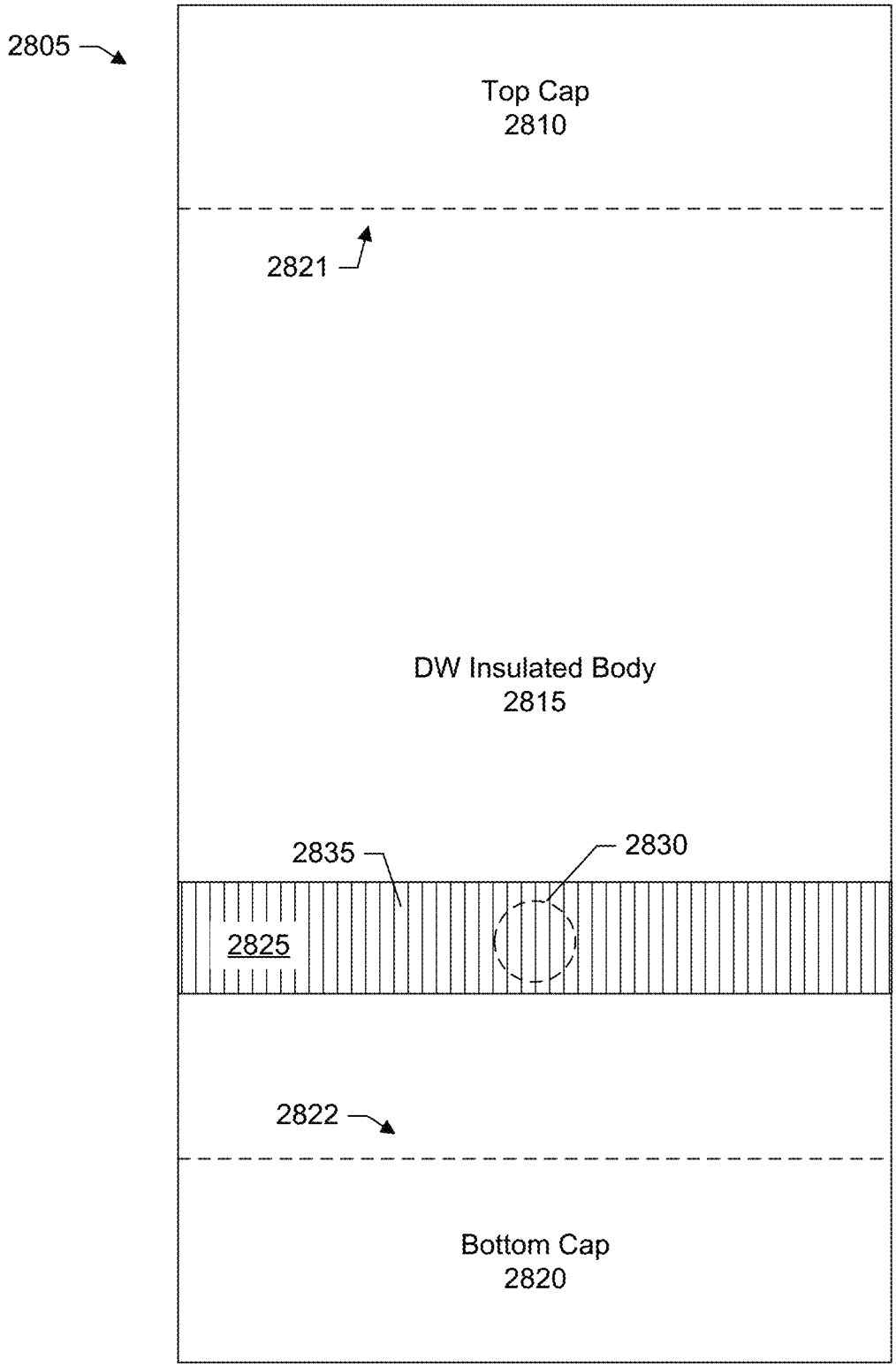
FIG. 28 shows a block diagram of a modular container having a double wall insulated body and no separate storage compartment according to a specific embodiment.

Alternatively, in another specific embodiment, there is a container without any separate storage compartment. FIG. 28 shows a container 2805 according to another specific embodiment. This container includes a top cap 2810, a double wall insulated container body 2815, and a bottom cap 2820. The top cap is removably connected over a top opening 2821 of the container body. The bottom cap is removably connected over a bottom opening 2822 of the container body, opposite the top opening. In this specific embodiment, the container body is a double wall insulated body. The container body includes a channel 2825, a vacuum port 2830 (with vacuum hole) within the channel, and a band 2835 positioned within the channel to cover the vacuum port. The band is shown using a pattern of vertical lines and the vacuum port is shown in broken lines to indicate that it is being covered by the band.

As discussed above, the vacuum port (with vacuum hole) allows the air between the shells of the double wall insulated body to be evacuated to create an insulated vacuum space. The vacuum port is located on a sidewall of the container body between the top and bottom caps.

In this specific embodiment, the container shown in FIG. 28 does not include a separate storage compartment. Rather, there is a single compartment between the top and bottom caps. In this specific embodiment, the bottom cap does not include any holes. That is, the bottom cap may include an outside surface that is continuous and uninterrupted by holes or other openings extending through a wall of the bottom cap. In other words, there are no holes in the bottom cap that are in fluid communication with an interior of the container body. The bottom cap can be removed from the container body to facilitate cleaning of the container body. In a specific embodiment, the top and bottom caps are interchangeable with each other. The top and bottom caps may be identical to each other. The top and bottom necks of the container body may be mirror images of each other.

In a specific embodiment, there is a bottom cap without any holes. In this specific embodiment, the user can purchase the container body, top cap, bottom cap with holes, bottom cap without holes, and, for example, the bag assembly. The user can assemble a container to have a first configuration that includes the container body, top cap, bottom cap with holes, and bag assembly. Alternatively, if the user does not wish to have a separate item storage compartment, the user can assemble a container to have a second configuration that omits the bag assembly and bottom cap with holes, but includes the same container body and top cap (and bottom cap without holes). A bottom cap without holes may be insulated.

Figure 29:
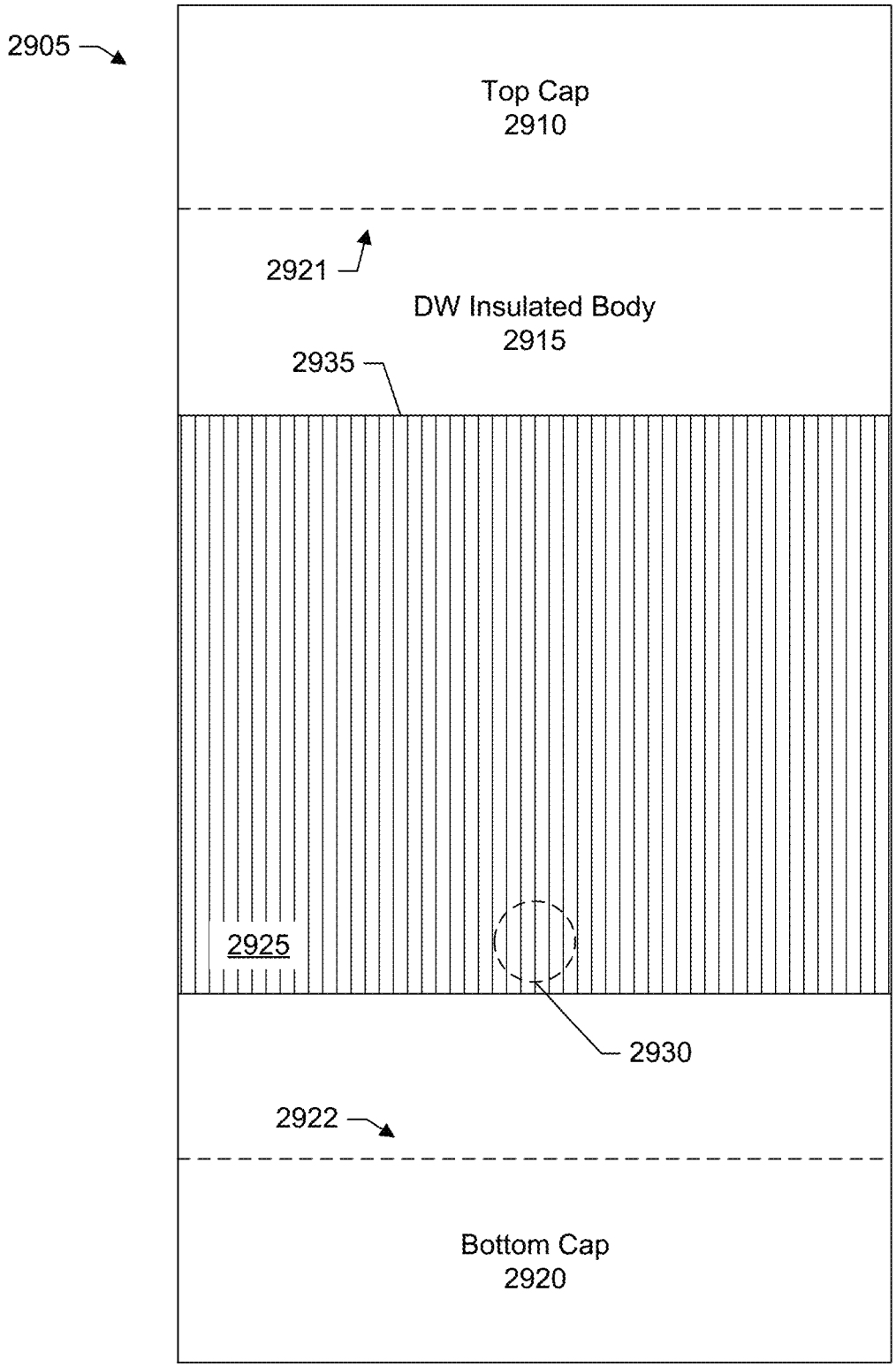
FIG. 29 shows a block diagram of a modular container having a double wall insulated body and no separate storage compartment according to another specific embodiment.

FIG. 29 shows a container 2905 according to another specific embodiment. The container shown in FIG. 29 is similar to the container shown in FIG. 28. For example, the container includes a top cap 2910, a double wall insulated container body 2915, a bottom cap 2920, a channel 2925, a vacuum port 2930 within the channel, and a band 2935 positioned within the channel to cover the vacuum port. The top cap is removably connected over a top opening 2921 of the container body. The bottom cap is removably connected over a bottom opening 2922 of the container body, opposite the top opening.

The channel and accompanying band shown in FIG. 29, however, is wider than the channel and accompanying band shown in FIG. 28. In this specific embodiment, the band further serves as a jacket to provide a surface for the user to hold the container. The band may include a rough surface texture to further help prevent the container from slipping from the user's grip. The band may substantially cover the outside surface of the container. A surface area of the band may be greater than a surface area of an outside side surface of the container body. A height of the band may be greater than a first distance from a top edge of the band to the top opening, a second distance from a bottom edge of the band to the bottom opening, or both.

Figure 30:
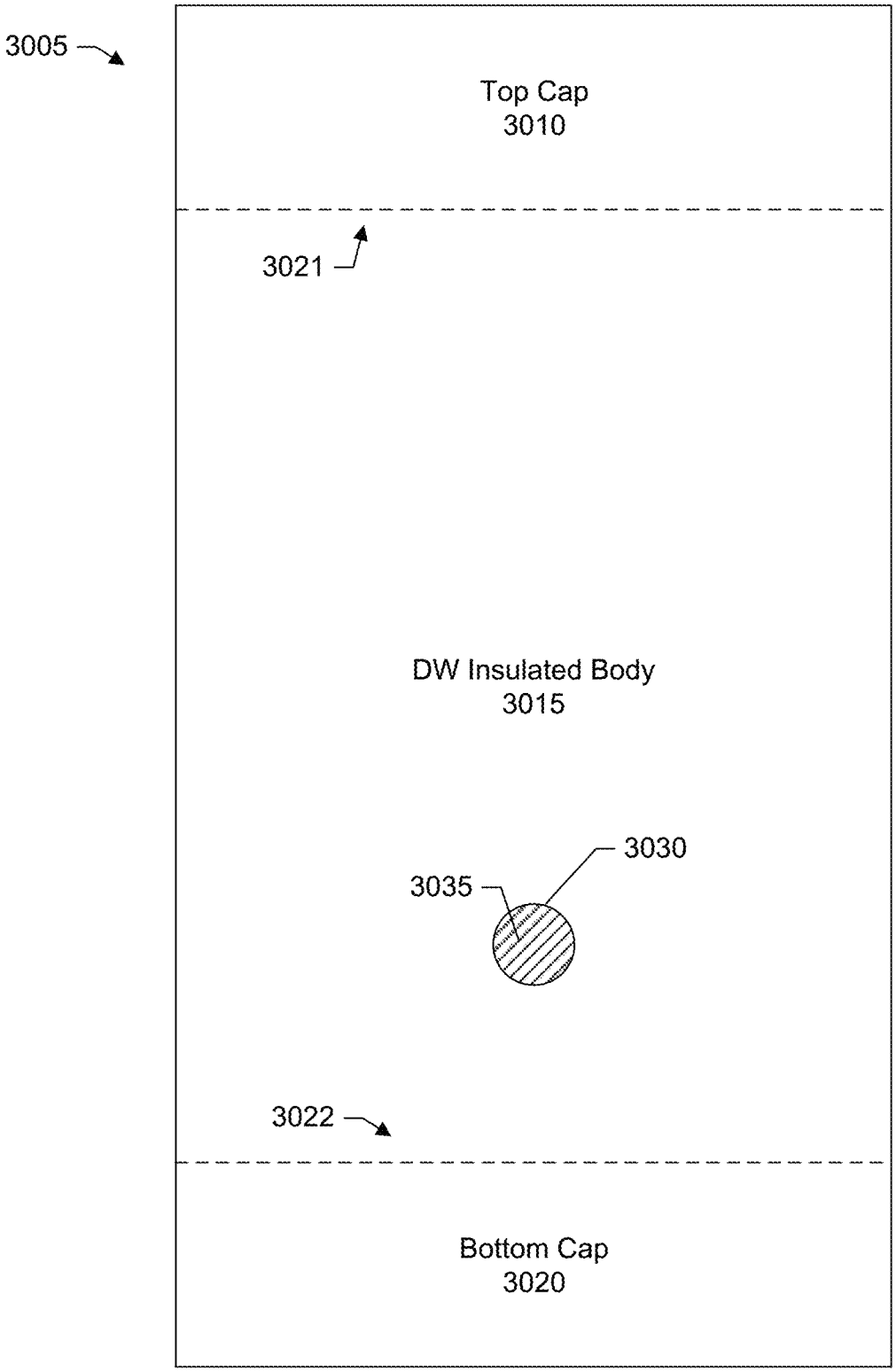
FIG. 30 shows a block diagram of a modular container having a double wall insulated body and no separate storage compartment according to another specific embodiment.

FIG. 30 shows a container 3005 according to another specific embodiment. The container shown in FIG. 30 is similar to the container shown in FIG. 28. For example, the container includes a top cap 3010, a double wall insulated container body 3015, a bottom cap 3020, and a vacuum port 3030. The top cap is removably connected over a top opening 3021 of the container body. The bottom cap is removably connected over a bottom opening 3022 of the container body, opposite the top opening.

The container shown in FIG. 30, however, does not include a channel in which the vacuum port is located. Rather, in this specific embodiment, the vacuum port is located on an outermost surface of a sidewall of the outer shell of the container body. In this specific embodiment, there is a plug or cover 3035 that is sealed over the vacuum port after air between the inner and outer shells of the container body has been at least partially evacuated via the vacuum port to create the vacuum insulated space. The plug or cover is shown in FIG. 30 using a pattern of diagonal lines.

A material of the cover may be the same as a material of the outer shell. For example, in a specific embodiment, the outer shell and cover may be made of stainless steel. In this specific embodiment, the cover is sealed over the vacuum port by welding the cover to the outer shell. The weld seam may then be filed to create a smooth surface finish between the cover and outer shell.

A material of the cover may be different from a material of the outer shell. For example, in another specific embodiment, the outer shell may include stainless steel and the cover may include a plug of brass. The brass may melted to fill the vacuum port and then filed to create a smooth surface finish. Alternatively, epoxy, resin, or another filler material may be used to fill the vacuum port.

Figure 31:
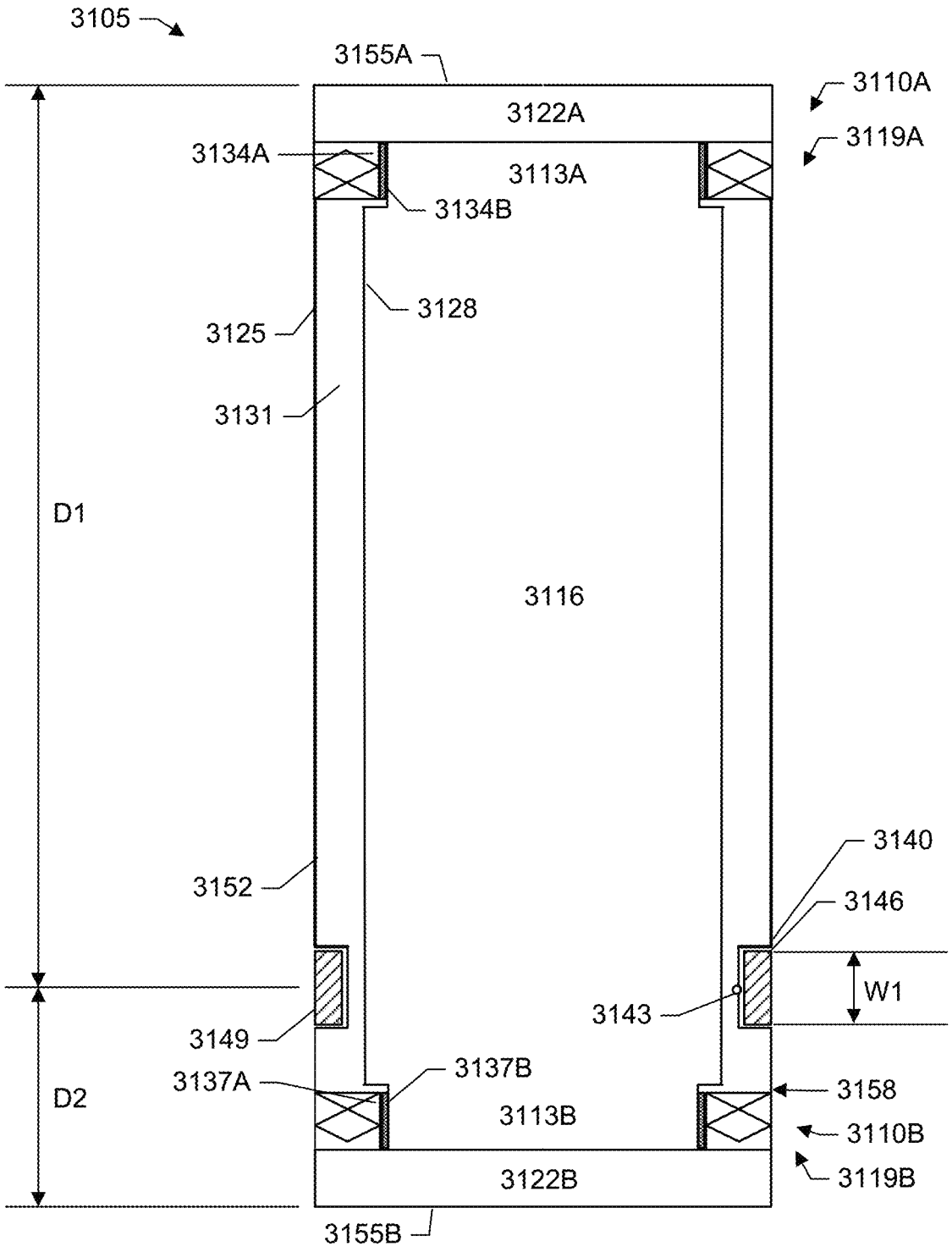
FIG. 31 shows a section view of a double wall insulated container with dual openings according to one or more embodiments.

FIG. 31 shows a section view of a container 3105 with a bottom opening and removable bottom cap according to one or more embodiments. The container shown in FIG. 31 may be similar to the container shown in FIG. 28. As shown in the example of FIG. 31, the container includes a double-wall insulated design. The container may be of a generally cylindrical shape. More particularly, the container includes a first end 3110A having a first opening 3113A extending into an interior space 3116 of the container, a second end 3110B, opposite the first end, and having a second opening 3113B extending into the interior space.

The interior space may be referred to as an internal reservoir. The internal reservoir can be used to store a food product such as a volume of liquid, solid, or semi-solid food product (e.g., soups, stews, pastas, and so forth).

The first and second ends include first and second threads 3119A,B, respectively. The first and second openings may be referred to as top and bottom openings, respectively. A first cap 3122A includes threads that engage with the first threads at the first end. A second cap 3122B includes threads that engage with the second threads at the second end. The first and second caps may be referred to as top and bottom caps, respectively. The dual openings (e.g., first and second openings) allow the container to be easily cleaned.

An outer wall 3125 and an inner wall 3128 extend between the first and second ends. The outer and inner walls may be referred to as outer and inner shells, respectively. The outer and inner walls are joined together at their respective first and second ends. An insulating vacuum space, sealed space, gap, or cavity 3131 is between the inner and outer walls. In a specific embodiment, the outer wall includes a top neck 3134A that is joined (e.g., welded) to a corresponding top neck 3134B of the inner wall; and a bottom neck 3137A that is joined (e.g., welded) to a corresponding bottom neck 3137B of the inner wall.

In a specific embodiment, a channel 3140 is formed on the outer wall. The channel may be formed using any competent manufacturing process such as forging, bending, stamping, casting, molding, machining, grinding, and so forth. The channel extends around or encircles the outside of the container like a ring. The channel extends towards the inner wall, but does not touch or contact the inner wall. For example, a depth of the channel may be less than a distance between the outer and inner walls. The channel is located between the first and second ends or threads of the container. In a specific embodiment, the channel is located closer or nearer to the second end (e.g., bottom) of the container than the first end (e.g., top) of the container. For example, a first distance D1 between the first end of the container and the channel may be greater than a second distance D2 between the channel and the second end of the container. Locating the band closer to one end of the container as compared to another end of the container can assist the user in determining the desired orientation of the container. In another specific embodiment, the channel may be located equidistant between the first and second ends. That is, the first distance may be equal to the second distance.

A bottom of the channel includes a vacuum port 3143. The vacuum port provides a hole or opening into the space between the outer and inner walls to evacuate or draw out air in the space and create the insulating vacuum. Once the air has been evacuated, the vacuum port can be sealed. It should be appreciated that other materials or coatings that provide a low thermal conductivity or otherwise reduce heat transfer may instead or additionally be used between the inner and outer walls. For example, foam may be injected between the inner and outer walls. The foam may be injected via the vacuum port or via a different opening into the cavity between the inner and outer walls. A surface of a wall may be coated such as with a copper coating.

A band 3146 is positioned in the channel to cover the vacuum port. In other words, like the channel, the band may extend around or encircle the outside of the container like a ring. The band is a flat, thin strip or loop of material. The band may be referred to as a strap, ring, hoop, ribbon, circlet, or loop. In an embodiment, a cross sectional shape of the band is a rectangle. The band is oriented within the channel such that a first long side of the rectangle is closer to a bottom of the channel than a second long side of the rectangle, opposite the first long side. The band may be sized so that an outside surface 3149 of the band is flush with an outside surface 3152 of the outer wall. For example, a thickness of the band may be equal to a depth of the channel. In a specific embodiment, a material of the band includes silicone. The band may be made of plastic, rubber, one or more polymer materials, wood, leather, or any other suitable material or combination of materials.

In an embodiment, the band provides a covering for the vacuum port so that that the vacuum port is not visible to the end user. The band is located on the outside surface of the container and is visible to the end user. The band can provide a grip so that the container can be securely held. In a specific embodiment, the outside surface of band, outer wall, and side surfaces of the first and second caps are flush with each other. That is, in this specific embodiment, an entire outside side surface of the container may be flush or smooth. The container may be symmetrical about a central or longitudinal axis passing through the container. A width W1 of the band may be greater than a distance between a bottom edge of the band a top edge 3158 of the second cap.

In a specific embodiment, a first distance is between a first point on a side surface of the first cap and a second point on the side surface, diametrically opposite the first point. A second distance is between a third point on an outside surface of the outer wall and a fourth point on the outside surface, diametrically opposite the third point. A third distance is between a fifth point on an outside surface of the band and a sixth point on the outside surface of the band, diametrically opposite the fifth point. A fourth distance is between a seventh point on a side surface of the second cap and an eighth point on the side surface of the second cap, diametrically opposite the seventh point. In a specific embodiment, the first, second, third, and fourth distances are equal to each other. In another specific embodiment, at least one of the first, second, third, and fourth distances may be different from another of the first, second, third, and fourth distances.

In a specific embodiment, there are no handles attached to the container. The lack of handles helps to facilitate a compact and obstruction-free packing of the bottle such as in a lunch box. In a specific embodiment, different containers can have different colored bands. Differently colored bands can be used to help users identify the contents being stored in the different containers. In an another specific embodiment, there can be a handle attached to the container. In another specific embodiment, a handle may be integrated with the first cap, second cap, or both.

In a specific embodiment, the first and second caps are identical to each other. For example, the first and second caps may be interchangeable with each other. That is, the first cap may be threaded onto the second end; and the second cap may be threaded onto the first end. This helps to lower the cost of the container as both the first and second caps may be produced from the same mold. The first cap, second cap, or both may include insulation or be insulated. In an embodiment, the first and second caps are designed to form an air-tight seal with the respective ends of the container. Sealing elements such as gaskets, washers, O-rings, and the like may be used with the first and second caps to help develop and ensure a good seal.

The first and second ends of the container may be identical or symmetrical to each other. In a specific embodiment, the first and second caps include flat base surfaces 3155A,B. This helps to provide the container with stability. For example, the container may be placed onto a surface in a first orientation. The container may be placed onto the surface in a second orientation that is flipped 180 degrees from the first orientation; and the container can remain stable in either orientation. In another specific embodiment, the first and second caps may be different from each other.

In a specific embodiment, a size of the first opening may be the same as a size of the second opening. A diameter of the first opening may be the same as a diameter of the second opening. In other specific embodiment, the size of the first and second openings may be different from each other.

In a specific embodiment, there can be a coupler that allows the user to increase the volume of the internal reservoir. In this specific embodiment, an end of a coupler may include threads adapted to threadably engage with threads at an end of a first container. A second end of the coupler may include threads adapted to threadably engage with threads at an end of a second container, different from the first container.

In a specific embodiment, there is an insulated container comprising: a container body comprising: a top neck comprising a top opening; a bottom neck, opposite the top neck, and comprising a bottom opening; an outer shell; an inner shell, encased by the outer shell; a vacuum space between the inner and outer shells; a channel, wherein the channel is recessed into a sidewall of the outer shell, is located on a side of the container body between the top and bottom necks, extends into the vacuum space, terminates before reaching the inner shell, and comprises a hole at a bottom of the channel through which air between the outer and inner shells is at least partially evacuated to create the vacuum space; and a band positioned within the channel and covering the hole, wherein a surface of the band is flush with a surface of the outer shell; a top cap removably coupled to the top neck; and a bottom cap removably coupled to the bottom neck. That is, in this specific embodiment, the surface of the band does not extend past the surface of the outer shell.

This application describes aspects of the invention in connection with the storage of food products. The principles of the invention, however, are also applicable to the storage of non-food products. For example, there can be a container including a first compartment, and a second compartment, separate from the first compartment, where volumes of the first and second compartment are adjustable based on items stored in the first and second compartments. The items may be food products, non-food products, solid items, non-solid items, things, or combinations of these.

In a specific embodiment, there is an insulated container comprising: a container body comprising: a top opening; a bottom opening, opposite the top opening; an outer shell; an inner shell, encased by the outer shell; a vacuum space between the inner and outer shells; a channel, formed in a sidewall of the outer shell, and located between the top and bottom openings, the channel comprising a vacuum port through which the vacuum space is created; and a band positioned in the channel and covering the vacuum port; a top cap removably coupled over the top opening; and a bottom cap removably coupled over the bottom opening. In an embodiment, the channel and band encircle the outer shell.

A diameter of the bottom opening may be substantially similar to a diameter of the bottom cap. A diameter of the bottom opening may be greater than a diameter of the top opening. A diameter of the bottom opening may be equal to a diameter of the top opening. A cross-sectional area of the bottom opening may be substantially similar to a cross-sectional area of the bottom cap. A cross-sectional area of the bottom opening may be greater than a cross-sectional area of the top opening. A cross-sectional area of the bottom opening may be equal to a cross-sectional area of the top opening.

In a specific embodiment, there are first threads about the bottom opening of the container body; second threads about the bottom opening of the container body; a bag assembly comprising: a bag comprising a bag opening defining the bottom opening of the container body; a sleeve, coupled to the bag opening, and comprising a passageway into the bag opening, and third threads; and at least one hole in the bottom cap, wherein the third threads of the sleeve engage with the first threads about the bottom opening to removably couple the bag assembly to the container body, wherein fourth threads of the bottom cap engage with the second threads about the bottom opening to removably couple the bottom cap to the container body, and wherein a diameter of the passageway is substantially similar to a diameter of the bag opening.

In another specific embodiment, there are first threads about the bottom opening of the container body; second threads about the bottom opening of the container body; and an insert comprising: a closed end; an open end, opposite the closed end; and third threads, wherein the third threads of the insert engage with the first threads about the bottom opening to removably couple the insert to the container body, wherein fourth threads of the bottom cap engage with the second threads about the bottom opening to removably couple the bottom cap to the container body, and wherein the open end of the insert faces the bottom cap.

The inner shell of the container body, outer shell of the container body, or both may include stainless steel.

In a specific embodiment, there is an insulated container comprising: a container body comprising: a top neck comprising a top opening, and top threads; a bottom neck, opposite the top neck, and comprising a bottom opening, and bottom threads; an outer shell comprising an outer shell top rim defining the top opening, and an outer shell bottom rim defining the bottom opening; an inner shell, encased by the outer shell, and comprising an inner shell top rim joined to the outer shell top rim, and an inner shell bottom rim joined to the outer shell bottom rim; a vacuum space between the inner and outer shells; a vacuum port to create the vacuum space, the vacuum port being located on a wall of the outer shell between the top and bottom necks, and being sealed after the vacuum space has been created; a top cap removably coupled to the top neck; and a bottom cap removably coupled to the bottom neck, wherein a diameter of the bottom opening is substantially similar to a diameter of the inner shell.

The insulated container may include a channel formed in the wall of the outer shell and encircling the outer shell; and a band positioned in the channel, wherein the vacuum port is within the channel, the band covers the vacuum port, and a surface of the band is flush with a surface of the wall of the outer shell. The insulated container may include a cover positioned over the vacuum port.

The insulated container may include a bag assembly comprising: a bag comprising a bag opening; a sleeve, coupled to the bag opening, and comprising first threads, and a passageway into the bag opening; and at least one hole in the bottom cap, wherein the bag assembly is removably coupled to the bottom neck of the insulated container via engagement of the first threads on the sleeve to second threads on the inner shell, wherein the bottom cap is removably coupled to the bottom neck of the container via engagement of threads of the bottom cap to third threads on the outer shell, the third threads of the outer shell being the bottom threads of the bottom neck, and wherein a diameter of the passageway is substantially similar to a diameter of the bag opening.

At least a portion of the third threads of the outer shell may overlap at least a portion of the second threads on the inner shell. The bottom cap may be insulated.

An inside diameter of the bottom cap may be substantially similar to a diameter of the bottom opening. A diameter of the bottom opening may be the same as a diameter of the top opening. A diameter of the bottom opening may be different from a diameter of the top opening. A diameter of the bottom opening may be greater than a diameter of the top opening.

In a specific embodiment, there is an insulated container comprising: a container body comprising: an outer shell; an inner shell, encased by the outer shell; a top neck comprising a top opening and formed at a top end of the outer and inner shells; a bottom neck comprising a bottom opening and formed at a bottom end of the outer and inner shells, opposite the top end; a vacuum space between the inner and outer shells; and a hole created through a sidewall of the outer shell; a top cap removably coupled to the top neck and over the top opening; and a bottom cap removably coupled to the bottom neck and over the bottom opening, wherein the hole through the sidewall of the outer shell is sealed after air between the inner and outer shells is at least partially evacuated to create the vacuum space.

Figures A-K in the appendix show various images of a specific embodiment of a modular container. Figure A shows a front view of the container. Figure B shows an exploded view of the container. Figure C shows an example of items that may be placed inside an adjustable storage compartment of the container. Figure D shows a portion of the items having been placed inside the adjustable storage compartment of the container. Figure E shows all the items having been placed inside the adjustable storage compartment of the container. Figure F shows the container being filled with water and the collapsing of the adjustable storage compartment. Figure G shows an example of the container in use. Figure H shows another example of the container in use. Figure I shows another example of the container in use. Figure J shows another example of the container in use. Figure K shows another example of the container in use.

Some specific flows and techniques are described in this application, but it should be understood that the invention is not limited to the specific flows and steps presented. A flow of the invention may have additional steps (not necessarily described in this application), different steps which replace some of the steps presented, fewer steps or a subset of the steps presented, or steps in a different order than presented, or any combination of these. Further, the steps in other implementations of the invention may not be exactly the same as the steps presented and may be modified or altered as appropriate for a particular application or based on the data.

This description of the invention has been presented for the purposes of illustration and description. It is not intended to be exhaustive or to limit the invention to the precise form described, and many modifications and variations are possible in light of the teaching above. The embodiments were chosen and described in order to best explain the principles of the invention and its practical applications. This description will enable others skilled in the art to best utilize and practice the invention in various embodiments and with various modifications as are suited to a particular use. The scope of the invention is defined by the following claims.

The invention claimed is:

1. A double-walled container comprising:
- a top opening;
- a bottom opening, opposite the top opening;
- a removable top cap that engages with threads at the top opening to seal the top opening;
- a removable bottom cap that engages with threads at the bottom opening to seal the bottom opening;
- an outer wall;
- an inner wall, the inner and outer walls having top edges joined to form the top opening, and bottom edges joined to form the bottom opening;
- a space between the outer and inner walls;
- a channel encircling the outer wall, between the top and bottom openings, and extending into the space;
- a vacuum port at a bottom of the channel to draw air out of the space and create a vacuum in the space; and
- a band positioned in the channel and covering the vacuum port.

2. The double-walled container of claim 1 wherein a depth of the channel is less than a distance between the outer and inner walls.

3. The double-walled container of claim 1 wherein the removable top and bottom caps are identical to each other.

4. The double-walled container of claim 1 wherein a size of the top opening is equal to a size of the bottom opening.

5. The double-walled container of claim 1 wherein the channel is closer to one of the top or bottom openings than another of the top or bottom openings.

6. The double-walled container of claim 1 wherein a distance between the channel and the bottom opening is equal to a distance between the channel and the top opening.

7. The double-walled container of claim 1 wherein an outside surface of the band is flush with an outside surface of the outer wall.

8. The double-walled container of claim 1 wherein the band comprises silicone.

9. The double-walled container of claim 1 wherein outside surfaces of the removable top cap, removable bottom cap, outer wall, and band are flush with each other.

10. The double-walled container of claim 1 wherein a width of the band is greater than a distance between a bottom edge of the band and a top edge of the bottom cap.

11. A double-walled container comprising:
- a top opening;
- a bottom opening, opposite the top opening, and having a size equal to a size of the top opening;
- a removable top cap that engages with threads at the top opening to seal the top opening;
- a removable bottom cap that engages with threads at the bottom opening to seal the bottom opening;
- an outer wall;
- an inner wall, the inner and outer walls having top edges joined to form the top opening, and bottom edges joined to form the bottom opening;
- a space between the outer and inner walls;
- a channel, the channel being formed around the outer wall, between the top and bottom openings, and extending into the space towards the inner wall;
- a vacuum port in the channel to draw air out of the space and create a vacuum in the space; and
- a band positioned in the channel and covering the vacuum port.

12. The double-walled container of claim 11 wherein a thickness of the band is equal to a depth of the channel, thereby allowing an outer surface of the band to be flush with an outer surface of the outer wall.

13. The double-walled container of claim 11 wherein the removable top and bottom caps are identical to each other.

14. The double-walled container of claim 11 wherein a cross-sectional shape of the band comprises a rectangle, and the band is positioned in the channel such that a long side of the rectangle is visible to a user.

15. The double-walled container of claim 11 wherein a depth of the channel is less than a distance between the outer and inner walls, the channel thereby not touching the inner wall.

16. A double-walled container comprising:
- a first end having first threads, and a first opening extending into an interior space for storing food;
- a second end having second threads, and a second opening, opposite the first opening, and extending into the interior space, a diameter of the second opening being the same as a diameter of the first opening;
- an outer wall extending between the first and second ends;
- an inner wall extending between the first and second ends, the inner and outer walls being welded together at the first and second ends;
- a gap between the outer and inner walls;
- a channel formed around the outer wall, the channel being between the first threads at the first end and the second threads at the second end, extending into the gap towards the inner wall, and comprising a vacuum port at a bottom of the channel to draw air out from the gap and form an insulating vacuum space between the outer and inner walls;
- a band retained within the channel and covering the vacuum port, the band comprising a thickness that is equal to a depth of the channel so that an outer surface of the band is flush with an outer surface of the outer wall;
- a first cap removably coupled to the first threads at the first end; and
- a second cap removably coupled to the second threads at the second end.

17. The double-walled container of claim 16 wherein the first and second caps are interchangeable with each other, the first cap thereby being capable of being removably coupled to the second threads at the second end, and the second cap thereby being capable of being removably coupled to the first threads at the first end.

18. The double-walled container of claim 16 wherein a cross-sectional shape of the band comprises a rectangle having a pair of long sides, and a pair of short sides, each long side being parallel to each other, and each short side being parallel to each other and perpendicular to the pair of long sides, and wherein the band is positioned in the channel such that a first long side of the band faces the bottom of the channel, and a second long side of the band, opposite the first long side, faces away from the bottom of the channel.

19. The double-walled container of claim 16 wherein surfaces of the first and second caps are flat to support the double-walled container sitting in a first orientation, and a second orientation, flipped 180 degrees from the first orientation.

20. The double-walled container of claim 16 wherein a first distance is between a first point on the band and a second point on the band, diametrically opposite the first point, a second distance is between a second point on the outer wall and a third point on the outer wall, diametrically opposite the second distance, and wherein the second distance is equal to the first distance.

* * * * *